US008820594B2

(12) United States Patent
Sakane et al.

(10) Patent No.: US 8,820,594 B2
(45) Date of Patent: Sep. 2, 2014

(54) FOLDING SYSTEM FOR FABRIC PRODUCT

(75) Inventors: Shinichi Sakane, Otsu (JP); Yoshimasa Endo, Otsu (JP); Hiroshi Kitagawa, Otsu (JP)

(73) Assignee: Seven Dreamers Laboratories, Inc., Redwood Shores, CA (US)

( * ) Notice: Subject to any disclaimer, the term of this patent is extended or adjusted under 35 U.S.C. 154(b) by 152 days.

(21) Appl. No.: 13/510,385

(22) PCT Filed: Oct. 22, 2010

(86) PCT No.: PCT/JP2010/006286

§ 371 (c)(1), (2), (4) Date: May 17, 2012

(87) PCT Pub. No.: WO2011/064941

PCT Pub. Date: Jun. 3, 2011

(65) Prior Publication Data

US 2012/0228340 A1 Sep. 13, 2012

(30) Foreign Application Priority Data

Nov. 30, 2009 (JP) ..... 2009-272686

(51) Int. Cl.
*A41H 33/00* (2006.01)
*A41H 43/00* (2006.01)
*B31B 1/26* (2006.01)

(52) U.S. Cl.
USPC ..... 223/37; 493/405

(58) Field of Classification Search
USPC ..... 223/37, 38; 270/32, 41, 45; 40/625, 40/630, 631, 638; 493/23, 405
See application file for complete search history.

(56) References Cited

U.S. PATENT DOCUMENTS

| | | | | |
|---|---|---|---|---|
| 3,419,199 | A * | 12/1968 | Lornitzo | 223/37 |
| 5,556,360 | A * | 9/1996 | Kober et al. | 493/23 |
| 5,715,555 | A * | 2/1998 | Reber et al. | 8/158 |
| 2005/0252967 | A1 * | 11/2005 | Kesler et al. | 235/385 |
| 2007/0021283 | A1 * | 1/2007 | Leifer et al. | 493/23 |
| 2008/0156705 | A1 * | 7/2008 | Markman | 209/552 |

(Continued)

FOREIGN PATENT DOCUMENTS

| | | | |
|---|---|---|---|
| JP | 2003-181200 | A | 7/1993 |
| JP | 05-294552 | A | 11/1993 |

(Continued)

OTHER PUBLICATIONS

International Search Report for PCT/JP2010/006286 dated Nov. 16, 2010.

(Continued)

*Primary Examiner* — Ismael Izaguirre
(74) *Attorney, Agent, or Firm* — Husch Blackwell LLP; Glenn H. Lenzen

(57) ABSTRACT

A folding system for a fabric product is provided. The folding system includes an information obtaining device, a folding device and a width controlling device. The information obtaining device obtains first information held by a fabric product. The folding device includes a platen member, a width adjusting mechanism and a folding mechanism. The platen member is for holding the fabric product. The width adjusting mechanism adjusts the width directional length of the platen member. The folding mechanism folds the fabric product on the platen member. The width controlling device controls the width adjusting mechanism by using the first information obtained by the information obtaining device.

15 Claims, 12 Drawing Sheets

(56) References Cited

U.S. PATENT DOCUMENTS

| | | | | |
|---|---|---|---|---|
| 2009/0188142 | A1* | 7/2009 | Chamandy | 40/625 |
| 2011/0023342 | A1* | 2/2011 | Davidson et al. | 40/638 |
| 2013/0117909 | A1* | 5/2013 | Paas | 2/244 |
| 2013/0130843 | A1* | 5/2013 | Burroughs et al. | 473/415 |

FOREIGN PATENT DOCUMENTS

| | | | |
|---|---|---|---|
| JP | 06-304399 | A | 11/1994 |
| JP | 07-036985 | | 2/1995 |
| JP | 07-61703 | A | 3/1995 |
| JP | 08-215497 | A | 8/1996 |
| JP | 08-215498 | A | 8/1996 |
| JP | 08-215499 | A | 8/1996 |
| JP | 08-215500 | A | 8/1996 |
| JP | 08-323100 | A | 12/1996 |
| JP | 10-218485 | A | 8/1998 |
| JP | 2002-119800 | A | 4/2002 |
| JP | 2003-432451 | A | 11/2003 |
| JP | 2006-320472 | | 11/2006 |
| JP | 2007-047657 | | 2/2007 |
| JP | 2008-18100 | A | 1/2008 |
| JP | WO2008/032826 | A1 | 3/2008 |
| JP | 2000-202200 | A | 9/2008 |
| JP | 2008-264316 | A | 11/2008 |

OTHER PUBLICATIONS

PCT International Preliminary Report on Patentability.

* cited by examiner

FIG. 3

Tr

| D0 IDENTIFICATION NUMBER | D1 PLATEN PLATE WIDTH | D2 TRANSPORTATION POSITION |
|---|---|---|
| FSL001-Gr | 300 | A001 |
| FSL002-Yw | 310 | A001 |
| FSS001-Gy | 285 | A002 |
| FSS003-Gy | 290 | A002 |
| MBS001-Br | 270 | B003 |
| MOS001-Rd | 265 | B007 |
| C1P021-Wt | 210 | C006 |
| C1P022-Wt | 205 | C006 |
| C2Tr2011-Bc | 195 | D007 |

FOLDING SYSTEM FOR FABRIC PRODUCT

CROSS-REFERENCE TO RELATED APPLICATIONS

This U.S. National Stage Application claims priority under 35 U.S.C. §119(a) to Japanese Patent Application No. 2009-272686, filed in Japan on Nov. 30, 2009. The entire disclosure of Japanese Patent Application No. 2009-272686 is hereby incorporated herein by reference.

TECHNICAL FIELD

The present invention relates to a folding system for a fabric product.

BACKGROUND ART

A variety of "folding devices for automatically folding a fabric product such as a shirt" have been proposed so far.

Depending on folding methods, the folding devices are roughly classified into slide type folding devices (see Japan Laid-open Patent Application Publication Nos. JP-A-H08-215500, JP-A-H08-215499, JP-A-H08-215498, JP-A-H08-215497, JP-A-2008-18100, JP-A-2000-202200 and JP-A-H05-294552), a flip-up-to-the-bottom type folding device (see Japan Laid-open Patent Application Publication Nos. JP-A-H06-304399 and JP-A-H10-218485), a flip-up-to-the-top type folding device (see Japan Laid-open Patent Application Publication Nos. JP-A-H07-61703, JP-A-2008-264316, JP-A-2003-532451, JP-A-2003-181200 and JP-A-2002-119800) and a rotary type folding device (see PCT International Application Publication No. WO2008/032826).

The folding devices as described above are mutually provided with a platen for putting a fabric product thereon. Every time the fabric product size is changed, the platen width is required to be suitably adjusted to the changed fabric product size. For example, the following methods are required for implementing the above. Every time the fabric product size is changed, a platen is replaced with another one with a width suitable for the fabric product size. Alternatively, the platen width is adjusted by means of a width adjusting mechanism as described in a brochure of International Patent Application Publication No. WO2008/032826 and etc. The latter method is herein preferable in consideration of a workload imposed on a worker.

Now, there exist a variety of fabric products for a variety of age groups (e.g., clothing of a grandfather, a grandmother, a father, a mother, a child and etc.) at home. Therefore, frequent width adjustment is required for the platen when the folding device as described above is installed in a home. A workload imposed on a worker is accordingly increased.

SUMMARY OF THE INVENTION

It is an object of the present invention to reduce worker's workload required for adjusting the platen width in a folding system for a fabric product.

A folding system for a fabric product according to a first aspect of the present invention includes an information obtaining device, a folding device and a width controlling device. The information obtaining device is configured to obtain first information held by the fabric product. It should be noted that the term "first information" may herein refer to identification information (including image information, identification number information, etc.), or alternatively, "information of the width directional length of a platen member". When the first information is the identification information, "information of the width directional length of a platen member" is required to be derived from the identification information. Further, the first information may be obtained from an information medium fixed to the fabric product. Examples of the information medium herein include a RFID tag, a barcode (e.g., one-dimensional barcode, two-dimensional barcode, further, a barcode made of fluorescent paint), fluorescent paint (forming information, for instance, by means of emission wavelength when being irradiated by black light), a metal piece (forming information depending on metal elements contained therein) and a magnetic recording medium. Alternatively, the first information may be data of the shape, the pattern, etc. of the fabric product (corresponding to the identification information in this case), in other words, imaging data (note the information obtaining device is herein an imaging device, i.e., a camera). The folding device includes a platen member, a width adjusting mechanism and a folding mechanism. It should be noted that examples of the folding mechanism include a rotary type folding mechanism as described in the brochure of PCT International Application Publication No. WO2008/032826, a flip-up-to-the-bottom type folding mechanism as described in Japan Laid-open Patent Application Publication Nos. JP-A-H06-304399 and JP-A-H10-218485, a flip-up-to-the-top type folding device as described in Publication of Japanese Translation of PCT International Application No. JP-A-2003-432451 and Japan Laid-open Patent Application Publication Nos. JP-A-H07-61703, JP-A-2008-264316, JP-A-2003-181200 and JP-A-2002-119800, and a slide type folding mechanism as described in Japan Laid-open Patent Application Publication Nos. JP-A-H08-215500, JP-A-H08-215499, JP-A-H08-215498, JP-A-H08-215497, JP-A-2008-18100, JP-A-2000-202200 and JP-A-H05-294552. The platen member is a member for putting the fabric product thereon. The width adjusting mechanism is configured to adjust a width directional length of the platen member. The folding mechanism is configured to fold the fabric product to be put on the platen member. The width controlling device is configured to control the width adjusting mechanism using the first information obtained by the information obtaining device.

According to the folding system for a fabric product of the first aspect of the present invention, the width controlling device is configured to control the width adjusting mechanism using the first information obtained by the information obtaining device. Therefore, the folding system for a fabric product requires a worker to execute only a work for assisting input of the first information into the information obtaining device (e.g., a work of disposing a fabric product to be closer to the information obtaining device). In other words, the folding system for a fabric product can reduce worker's workload required for adjusting the width of the platen.

A folding system for a fabric product according to a second aspect of the present invention relates to the folding system for a fabric product according to the first aspect of the present invention. In the folding system, the first information is identification information for the fabric product. The folding system further includes a first storage device and a second information deriving device. The first storage device is configured to store a first association table. In the first association table, the first information is associated with second information. The second information deriving device is configured to check the first information obtained by the information obtaining device against the first association table and derive the second information associated with the first information therefrom. The width controlling device is configured to control the width adjusting mechanism using the second information derived by the second information deriving device.

According to the folding system for a fabric product of the second aspect of the present invention, it is possible to reduce the information amount of the first information. Therefore, the folding system for a fabric product can reduce the cost of a medium holding the first information and reduce chances of causing troubles, for instance, in repurchase of fabric products (e.g., clothing).

A folding system for a fabric product according to a third aspect of the present invention relates to the folding system for a fabric product according to the first aspect of the present invention. The folding system further includes a sorting device. The sorting device is configured to sort the fabric product folded by the folding device using the first information. It should be herein noted that the first information may contain "sorting information (e.g., owner information, storage position information, etc.)".

According to the folding system for a fabric product of the third aspect of the present invention, the fabric products can be sorted depending on owners of or storage positions of the fabric products. Therefore, the folding system for a fabric product can eliminate a sorting-related workload of a worker.

A folding system for a fabric product according to a fourth aspect of the present invention relates to the folding system for a fabric product according to the third aspect of the present invention. In the folding system, the first information is identification information for the fabric product. The folding system further includes a second storage device and a third information deriving device. The second storage device is configured to store a second association table. In the second association table, the first information is associated with third information. The third information deriving device is configured to check the first information obtained by the information obtaining device against the second association table and derive the third information associated with the first information therefrom. Further, the sorting device is configured to sort the fabric product folded by the folding device using the third information derived by the third information deriving device.

According to the folding system for a fabric product of the fourth aspect of the present invention, it is possible to reduce the information amount of the first information. Therefore, the folding system for a fabric product can reduce the cost of a medium holding the first information and reduce chances of causing troubles, for instance, in repurchase of fabric products (e.g., clothing).

A folding system for a fabric product according to a fifth aspect of the present invention relates to the folding system for a fabric product according to the third aspect of the present invention. The folding system further includes a transporting device. The transporting device is configured to transport the fabric product sorted by the sorting device to a predetermined storage position using the first information. It should be herein noted that the first information may contain "transportation position information".

According to the folding system for a fabric product of the fifth aspect of the present invention, the fabric product is automatically transported to a predetermined storage position after being sorted depending on an owner of or a storage position of the fabric product. Therefore, the folding system for a fabric product can eliminate a storage-related workload of a worker.

A folding system for a fabric product according to a sixth aspect of the present invention relates to the folding system for a fabric product according to the fifth aspect of the present invention. In the folding system, the first information is identification information for the fabric product. Further, the folding system further includes a third storage device and a fourth storage device. The third storage device is configured to store a third association table. In the third association table, the first information is associated with fourth information. The fourth information deriving device is configured to check the first information obtained by the information obtaining device against the third association table and derive the fourth information associated with the first information therefrom. Yet further, the transporting device is configured to transport the fabric product sorted by the sorting device to a predetermined storage position using the fourth information derived by the fourth information deriving device.

According to the folding system for a fabric product of the sixth aspect of the present invention, it is possible to reduce the information amount of the first information. Therefore, the folding system for a fabric product can reduce the cost of a medium holding the first information and reduce chances of causing troubles, for instance, in repurchase of fabric products (e.g., clothing).

A folding system for a fabric product according to a seventh aspect of the present invention relates to the folding system for a fabric product according to one of the fifth and sixth aspects of the present invention. In the folding system, the sorting device is disposed below or lateral to the folding device, while the transporting device is disposed below the sorting device.

According to the folding system for a fabric product of the seventh aspect of the present invention, the folding system for a fabric product can supply the fabric product to the transporting device by means of inertia forth (gravity force) after sorting by the sorting device. Therefore, the folding system for a fabric product is expected to contribute to energy saving.

A folding system for a fabric product according to an eighth aspect of the present invention relates to the folding system for a fabric product according to one of the first to seventh aspects of the present invention. In the folding system, the fabric product is provided with a medium containing the first information. The medium is herein fixed to a predetermined position on the fabric product. It should be herein noted that examples of "the medium" include a RFID tag, fluorescent paint (including the patterned one), a metal piece and a magnetic recording medium. Moreover, the folding system for a fabric product further includes a position detecting device, a clamping device and a clamping device controlling device. The position detecting device is configured to detect a position of the first information. The clamping device is configured to clamp the fabric product. The clamping device controlling device is configured to control the clamping device for causing the clamping device to hold the position of the fabric product detected by the position detecting device and put the fabric product on the platen member.

According to the folding system for a fabric product of the eighth aspect of the present invention, it is possible to cause the clamping device to easily clamp the fabric product at an appropriate clamping position. Therefore, the folding system for a fabric product can appropriately put the fabric product on the platen member of the folding device.

BRIEF DESCRIPTION OF THE DRAWINGS

FIG. 3 is a conceptual diagram of a matching table stored in a storage unit of the control device of the automatic wash-dry-fold system according to the exemplary embodiment of the present invention.

DETAILED DESCRIPTION OF THE EMBODIMENTS

Figure 1:
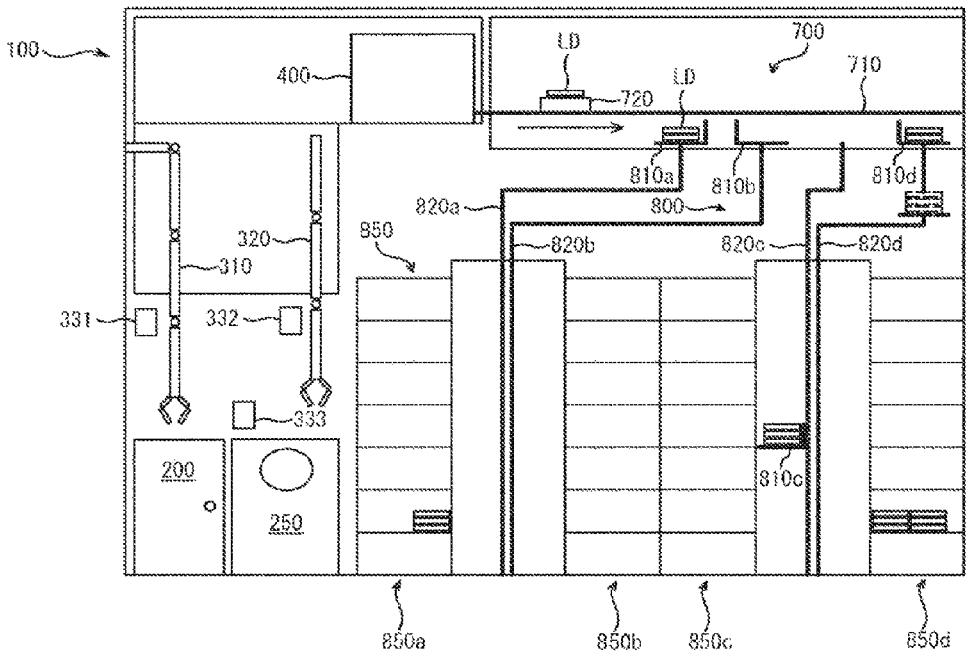
FIG. 1 is a schematic configuration diagram of an automatic wash-dry-fold system according to an exemplary embodiment of the present invention.

An automatic wash-dry-fold system 100 according to an exemplary embodiment of the present invention is configured to wash, dry and fold a laundry in a fully automatic manner. As illustrated in FIG. 1, the automatic wash-dry-fold system 100 mainly includes a washing machine 200, a drying machine 250, RFID tag readers 331 to 333, a laundry transporting robot arm 310, a dried laundry transporting robot arm 320, a folding device 400, a sorting device 700, a transporting device 800 and a closet 850.

It should be noted in the present exemplary embodiment that each of all the laundries LD includes two passive-type RFID tags (not illustrated in the figures) attached to two specific portions thereof (e.g., "shoulder parts" for a shirt, "waist parts" for pants and etc.). Further, each RFID tag stores identification number data D0 (see FIG. 3) uniquely set for each laundry LD (e.g., clothing).

The aforementioned elements will be hereinafter described in detail.

<Elements of Automatic Wash-Dry-Fold System>

(1) Washing Machine

Figure 2:
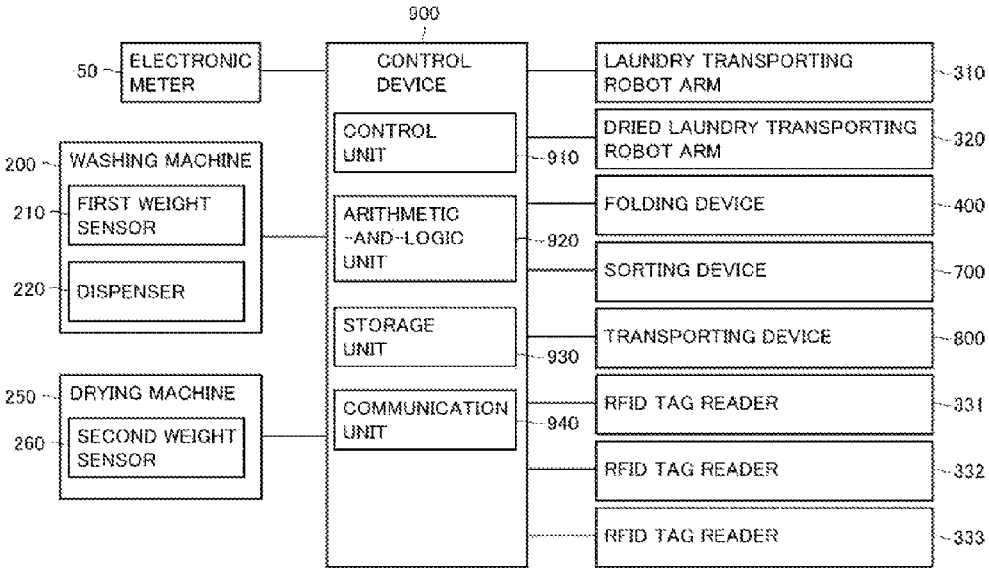
FIG. 2 is a schematic diagram of a control device of the automatic wash-dry-fold system according to the exemplary embodiment of the present invention.

The washing machine 200 is a normal washing machine and is communicatively connected to a control device 900 as represented in FIG. 2. Further, the washing machine 200 is configured to automatically open or close a cover, put therein a detergent and/or a softener from a dispenser 220 (see FIG. 2), and start or stop an operation in response to a command from the control device 900.

Further, the washing machine 200 includes a first weight sensor 210 (see FIG. 2) attached thereto. The first weight sensor 210 is configured to measure the weight of the laundries LD put into a washing tub of the washing machine 200. Further, the washing machine 200 is configured to transmit a measured value of the weight to the control device 900 at predetermined time intervals.

(2) Drying Machine

The drying machine 250 is a normal drying machine and is communicatively connected to the control device 900 as represented in FIG. 2. Further, the drying machine 250 is configured to automatically open or close a cover, and start or stop an operation in response to a command from the control device 900.

Further, the drying machine 250 includes a second weight sensor 260 (see FIG. 2) attached thereto. The second weight sensor 260 is configured to measure the weight of the laundries LD put into a drying drum of the drying machine 250. The drying machine 250 is configured to transmit a measured value of the weight to the control device 900 at predetermined time intervals.

(3) RFID Tag Readers

The RFID tag readers 331 to 333 are readout devices for RFID tags. Each of the RFID readers 331 to 333 is configured to irradiate radio waves towards a RFID tag for actuating the RFID tag and receive the identification number data D0 from the RFID tag.

Further, the present system 100 includes three sets of RFID tag readers (331 to 333) installed therein. Each of the RFID tag readers 331 to 333 is communicatively connected to the control device 900 as represented in FIG. 2. The RFID tag readers 331 to 333 are herein configured to transmit intensity data of reflective waves from the RFID tags to the control device 900. In response, the control device 900 is configured to detect the positions of the RFID tags by means of the triangulation method based on the intensity data of the reflective waves received from the respective RFID tag readers 331 to 333.

(4) Laundry Transporting Robot Arm

The laundry transporting robot arm 310 is a robot arm including a two-finger hand attached to the tip thereof. As represented in FIG. 2, the laundry transporting robot arm 310 is communicatively connected to the control device 900. The laundry transporting robot arm 310 is configured to move the laundries LD from a laundry basket to the washing machine 200 and move the laundries LD from the washing machine 200 to the drying machine 250 in response to a command from the control device 900. It should be noted that the laundry transporting robot arm 310 is configured to sequentially pick up the RFID tags in response to a command from the control device 900, starting from the one positioned on the top of the RFID tags (i.e., the specific part of the laundry LD).

(5) Dried Laundry Transporting Robot Arm

Similarly to the laundry transporting robot arm 310, the dried laundry transporting robot arm 320 is a robot arm including a two-finger hand attached to the tip thereof. As represented in FIG. 2, the dried laundry transporting robot arm 320 is communicatively connected to the control device 900. In response to a command from the control device 900, the dried laundry transporting robot arm 320 is configured to pick up one of the dried laundries LD from the drying machine 250 and halt in a predetermined position. It should be noted that the dried laundry transporting robot arm 320 is configured to sequentially pick up the RFID tags in response to a command from the control device 900, starting from the one positioned on the top of the RED tags, (i.e., the specific part of the laundry LD).

(6) Folding Device

Figure 4:
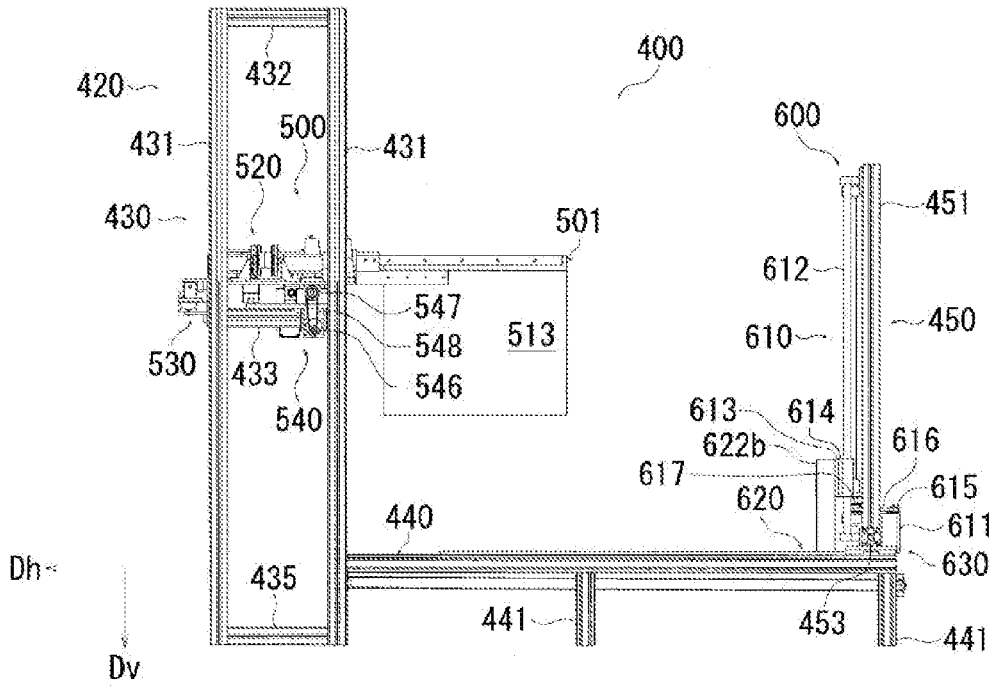
FIG. 4 is a side view of a folding device of the automatic wash-dry-fold system according to the exemplary embodiment of the present invention.
Figure 5:
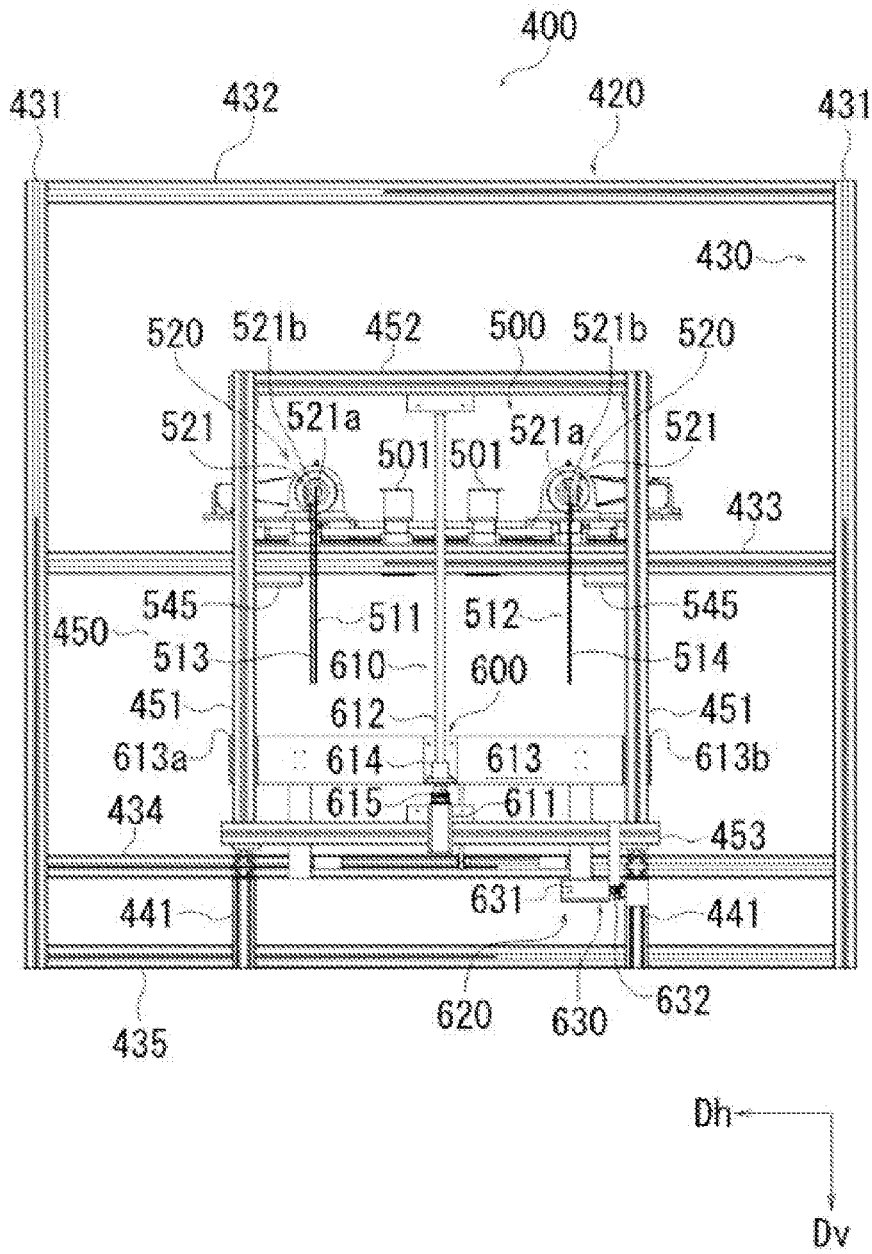
FIG. 5 is a front view of the folding device of the automatic wash-dry-fold system according to the exemplary embodiment of the present invention.
Figure 6:
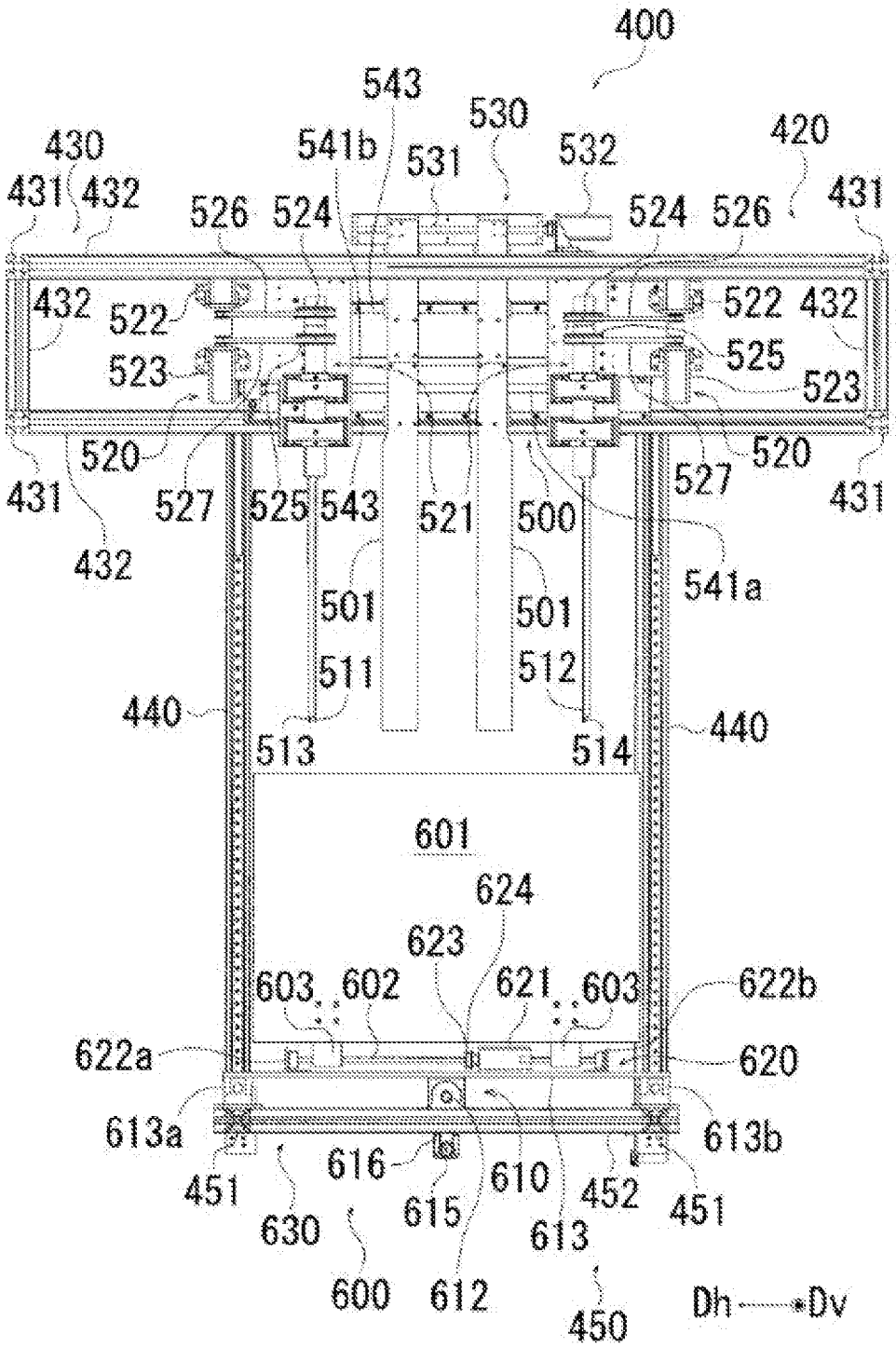
FIG. 6 is a plan view of the folding device of the automatic wash-dry-fold system according to the exemplary embodiment of the present invention.

As illustrated in FIGS. 4 to 6, the folding device 400 mainly includes a frame 420, a folding mechanism 500 and a transporting mechanism 600. As illustrated in FIG. 1, the folding device 400 is disposed under the roof of a house or the like. As represented in FIG. 2, the folding device 400 is further communicatively connected to the control device 900. The folding device 400 is configured to adjust the width between platen plates (to be described), fold the laundry LD, and deliver the laundry LD to the sorting device 700 in a folded state in response to a command from the control device 900. Elements of the folding device 400 will be hereinafter respectively described in detail.

(6-1) Frame

As illustrated in FIGS. 4 to 6, the frame 420 is mainly formed by a front frame 430, side frames 440 and a rear frame 450.

As illustrated in FIGS. 4 to 6, the front frame 430 is mainly formed by four first pillar members 431, four first upper beam members 432, four first intermediate beam members 433, a second intermediate beam member 434 and four first lower beam members 435. The first pillar members 431 are disposed while the axes thereof are arranged along a vertical direction Dv. The first upper beam members 432 are extended among the first pillar members 431 in a horizontal direction Dh in order to connect the top ends of the first pillar members 431. The first intermediate beam members 433 are extended among the first pillar members 431 in the horizontal direction Dh in order to connect the intermediate parts of the first pillar members 431 in the height direction. It should be noted that the folding mechanism 500 is fixed to the first intermediate beam members 433 as illustrated in FIGS. 4 to 6. The second intermediate beam member 434 is extended between rear-frame side two of the first pillar members 431 in the horizontal direction Dh in order to connect parts, positioned slightly above the bottom ends, of the rear-frame side two first pillar members 431. The first lower beam members 435 are extended among the first pillar members 431 in the horizontal direction Dh in order to connect the bottom ends of the first pillar members 431.

As illustrated in FIGS. 4 to 6, the side frames 440 are two beam members, each of which connects a lower part of the front frame 430 and that of the rear frame 450. Further, four leg members 441 are attached to the side frames 440.

As illustrated in FIGS. 4 to 6, the rear frame 450 is mainly formed by two second pillar members 451, a second upper beam member 452 and a second lower beam member 453. It should be noted that the transporting mechanism 600 is attached to the rear frame 450. The second pillar members 451 are disposed while the axes thereof are arranged along the vertical direction Dv. The second upper beam member 452 is extended between the second pillar members 451 in the horizontal direction Dh in order to couple the top ends of the second pillar members 451. The second lower beam member 453 is extended under the second pillar members 451 in the horizontal direction Dh in order to couple the bottom ends of the second pillar members 451.

(6-2) Folding Mechanism

As described above, the folding mechanism 500 is fixed to the first intermediate beam members 433. As illustrated in FIGS. 4 to 6, the folding mechanism 500 mainly includes a pair of platen plates 501, four folding plates 511 to 514, dual nested shaft rotary mechanisms 520, an inter-platen-plate distance adjusting mechanism 530 and folding plate sliding mechanisms 540. It should be noted that the folding plates with reference numerals of 511, 512, 513 and 514 may be hereinafter referred to as "a first folding plate", "a second folding plate", "a third folding plate" and "a fourth folding plate". Elements of the folding mechanism 500 will be hereinafter respectively explained in detail.

The platen plates 501 are a pair of roughly rectangular plate members. As illustrated in FIG. 4, each platen plate 501 is extended towards the rear frame in the horizontal direction. In an initial state, the laundry LD is put on the platen plates 501. When the folding device 400 receives a command signal and platen plate width data D1 sent from the control device 900, the inter-platen-plate distance adjusting mechanism 530 is configured to adjust the width between the platen plates 501 based on the platen plate width data D1.

The folding plates 511 to 514 are members for serving to fold the laundry LD put on the platen plates 501. As illustrated in FIGS. 4 to 6, each of the folding plates 511 to 514 has a roughly rectangular shape. The folding plates 511 to 514 are disposed beside the platen plates 501 while being arranged perpendicularly thereto in an initial state.

As illustrated in FIGS. 5 and 6, the dual nested shaft rotary mechanisms 520 are a pair of mechanisms disposed in the right-and-left direction. Each dual nested shaft rotary mechanism 520 mainly includes a dual nested shaft 521, an inner shaft rotary motor 522, an outer shaft rotary motor 523, an inner shaft pulley 524, an outer shaft pulley 525, a first pulley belt 526 and a second pulley belt 527. Each dual nested shaft 521 is formed by an inner shaft 521*a* and an outer shaft 521*b*. It should be noted that each inner shaft 521*a* is a columnar shaft that the folding plate 511/512 is attached to the tip thereof. On the other hand, each outer shaft 521*b* is a cylindrical shaft that the folding plate 513/514 is attached to the tip thereof. Further, each inner shaft 521*a* is rotatably inserted into each outer shaft 521*b* while the base end thereof is partially protruded from each outer shaft 521*b*. Each inner shaft pulley 524 is fitted into the base end of each inner shaft 521*a*. Each outer shaft pulley 525 is fitted into the base end of each outer shaft 521*b*. Each first pulley belt 526 is stretched over a shaft of each inner shaft rotary motor 522 and each inner shaft pulley 524. Each first pulley belt 526 serves to transfer rotary power of each inner shaft rotary motor 522 to each inner shaft 521*a* for rotating each inner shaft 521*a*. Each second pulley belt 527 is stretched over a shaft of each outer shaft rotary motor 523 and each outer shaft pulley 525. Each second pulley belt 527 serves to transfer rotary power of each outer shaft rotary motor 523 to each outer shaft 521*b* for rotating each outer shaft 521*b*. Each inner shaft rotary motor 522 and each outer shaft rotary motor 523 are forwardly and reversely rotatable.

As illustrated in FIGS. 4 and 5, the inter-platen-plate distance adjusting mechanism 530 mainly includes a first ball screw 531, first nuts (not illustrated in the figures), a first rail member (not illustrated in the figures), a platen plate attachment member (not illustrated in the figures) and a first ball screw driving motor 532. The first ball screw 531 is formed by a right-handed thread ball screw portion and a left-handed thread ball screw portion. It should be herein noted that the right-handed thread ball screw portion and the left-handed thread ball screw portion are disposed concentrically to each other. Further, the first ball screw 531 is rotatably fixed to the first rail member while the axis thereof is arranged in parallel to the rail portion (not illustrated in the figures) of the first rail member. The first nuts are screwed onto the right-handed thread ball screw portion and the left-handed thread ball screw portion of the first ball screw 531, respectively. The first nuts are configured to be slid and moved on the rail portion along the axial direction of the first ball screw 531 in conjunction with driving of the first ball screw driving motor 532. It should be noted in the present exemplary embodiment that the first nuts are configured to be slid and moved in opposite directions due to the structure that the first nuts are respectively screwed onto the right-handed thread ball screw portion and the left-handed thread ball screw portion of the first ball screw 531. In other words, the first nuts are configured to be slid and moved closer to or away from each other. Further, the platen plate attachment member serves to fix the platen plates 501 to the first nuts. Yet further, the platen plate attachment member includes a rail engaging portion (not illustrated in the figures) on the back face thereof. The rail engaging portion is meshed with the rail portion of the first rail member. The first ball screw driving motor 532 is coupled to an end of the first ball screw 531 while the shaft thereof is arranged along the axis of the first ball screw 531.

A pair of the folding plate sliding mechanisms 540 is disposed correspondingly to the dual nested shaft rotary mechanisms 520 in the right-and-left direction. As illustrated in FIGS. 4 to 6, the folding plate sliding mechanisms 540 mainly include the third ball screws 541*a* and 541*b*, third nuts (not illustrated in the figures), third rail members 543, third ball screw driving motors 545, $31^{st}$ pulleys 546, $32^{nd}$ pulleys 547 and third pulley belts 548. Further, in the following explanation, the third ball screws with reference numerals of 541*a* and 541*b* may be respectively referred to as "a $31^{st}$ ball screw" and "a $32^{nd}$ ball screw". As illustrated in FIGS. 4 to 6, two third ball screws 541*a* and 541*b* are disposed in roughly parallel to the first ball screw 531. The third nuts are screwed onto two third ball screws 541*a* and 541*b*, respectively. The dual nested shaft rotary mechanisms 520 are attached to the third nuts, respectively. Each $31^{st}$ pulley 546 is fitted onto the tip of each third ball screw driving motor 545. Each $32^{nd}$ pulley 547 is fitted onto the base end of each third ball screw 541*a*/541*b*. Each third pulley belt 548 is stretched over each $31^{st}$ pulley 546 and each $32^{nd}$ pulley 547. Each third pulley belt 548 serves to transfer rotary power of each third ball screw driving motor 545 to each third ball screw 541*a*/541*b* through each $31^{st}$ pulley 546 and each $32^{nd}$ pulley 547 in order to rotate each third ball screw 541*a*/541*b*. Each third ball screw driving motor 545 is forwardly and reversely rotatable.

(6-3) Transporting Mechanism

As illustrated in FIGS. 4 to 6, the transporting mechanism 600 mainly includes a pull-out plate 601, a pull-out plate up-and-down transporting mechanism 610, a pull-out plate rotary mechanism 620 and a pull-out plate back-and-forth transporting mechanism 630. Elements of the transporting mechanism 600 will be hereinafter respectively explained in detail.

The pull-out plate 601 is a roughly rectangular plate member. It should be noted that the pull-out plate 601 includes two protrusions 603 and a rotary bar 602 as illustrated in FIG. 6. The protrusions 603 are backwardly extended, while the rotary bar 602 is fixed to the protrusions 603. Further, a $21^{st}$ pulley (not illustrated in the figure) is attached to the rotary bar 602.

As illustrated in FIGS. 4 to 6, the pull-out plate up-and-down transporting mechanism 610 mainly includes a fourth ball screw 612, a fourth ball screw driving motor 611, a fourth nut 614, an attachment plate 613, an $11^{th}$ pulley 615, a $12^{th}$ pulley belt 616 and a $12^{th}$ pulley 617. As illustrated in FIGS. 4 to 6, the fourth ball screw 612 is disposed while the axis thereof is arranged along the vertical direction Dv. The fourth nut 614 is screwed onto the fourth ball screw 612. The fourth nut 614 is configured to be moved along the axial direction of the fourth ball screw 612 in conjunction with driving of the fourth ball screw driving motor 611. The fourth nut 614 is fixed to the attachment plate 613. Further, the attachment plate 613 includes rail portions 613*a* and 613*b* on the both ends thereof. It should be noted that the rail portions 613*a* and 613*b* are fitted onto the second pillar members 451 of the rear frame 450. Therefore, the attachment plate 613 is configured to be moved up and down along the second pillar members 451 when the fourth nut 614 is moved up and down along the fourth ball screw 612. Further, the pull-out plate 601 is attached to the front face of the attachment plate 613 through the pull-out plate rotary mechanism 620. As illustrated in FIGS. 4 to 6, the $11^{th}$ pulley 615 is attached to the shaft of the fourth ball screw driving motor 611. As illustrated in FIG. 4, the $12^{th}$ pulley 617 is attached to the bottom end of the fourth ball screw 612. The $12^{th}$ pulley belt 616 is stretched over the $11^{th}$ pulley 615 and the $12^{th}$ pulley 617. In other words, in conjunction with driving of the fourth ball screw driving motor 611, rotational power of the fourth ball screw driving motor 611 is transferred to the fourth ball screw 612 through the $11^{th}$ pulley 615, the $12^{th}$ pulley belt 616 and the $12^{th}$ pulley 617. As a result, the fourth ball screw 612 is rotated about the axis thereof. The attachment plate 613 is consequently moved up and down along the second pillar members 451.

As illustrated in FIG. 6, the pull-out plate rotary mechanism 620 mainly includes rotary bar support bodies 622*a* and 622*b*, a $22^{nd}$ pulley 623, a $22^{nd}$ pulley belt 624 and a rotary bar driving motor 621. The rotary bar support bodies 622*a* and 622*b* support the rotary bar 602 disposed rearwards of the pull-out plate 601 for allowing it to rotate. The $22^{nd}$ pulley 623 is attached to the shaft of the rotary bar driving motor 621. The $22^{nd}$ pulley belt 624 is stretched over the $22^{nd}$ pulley 623 and the 20 pulley attached to the rotary bar 602. In short, in conjunction with driving of the rotary bar driving motor 621, rotational power of the rotary bar driving motor 621 is transferred to the rotary bar 602 through the $22^{nd}$ pulley 623, the $22^{nd}$ pulley belt 624 and the $21^{st}$ pulley. As a result, the pull-out plate 601 is upwardly pivoted and lifted up. In reverse driving of the rotary bar driving motor 621, by contrast, rotary power of the rotary bar driving motor 621 is transferred to the rotary bar 602 through the $22^{nd}$ pulley 623, the $22^{nd}$ pulley belt 624 and the 20 pulley. As a result, the pull-out plate 601 is downwardly pivoted and tilted downwards.

The pull-out plate back-and-forth transporting mechanism 630 is disposed for implementing back-and-forth movement of the transporting mechanism 600. As illustrated in FIG. 5, the pull-out plate back-and-forth transporting mechanism 630 mainly includes a back-and-forth driving motor 631, a wire (not illustrated in the figure) and a wire support portion 632. In conjunction with driving of the back-and-forth driving motor 631, the wire is configured to be moved along the wire support portion 632. In conjunction with the wire movement, the transporting mechanism 600 is configured to be moved back and forth.

(6-4) Actions of Folding Device

Actions of the folding device 400 will be hereinafter explained with reference to FIGS. 4 to 14.

In the folding device 400, the folding mechanism 500 is firstly set to be in a state illustrated in FIG. 5. In other words, the folding device 400 is set to be in a state (initial state) that the folding plates 511 to 514 are hung down roughly in the vertical direction in a front view. In the state, a laundry LD is put on the platen plates 501. It should be noted that the width between the platen plates 501 is adjusted by the inter-platen-plate distance adjusting mechanism 530 as described above.

Figure 7:
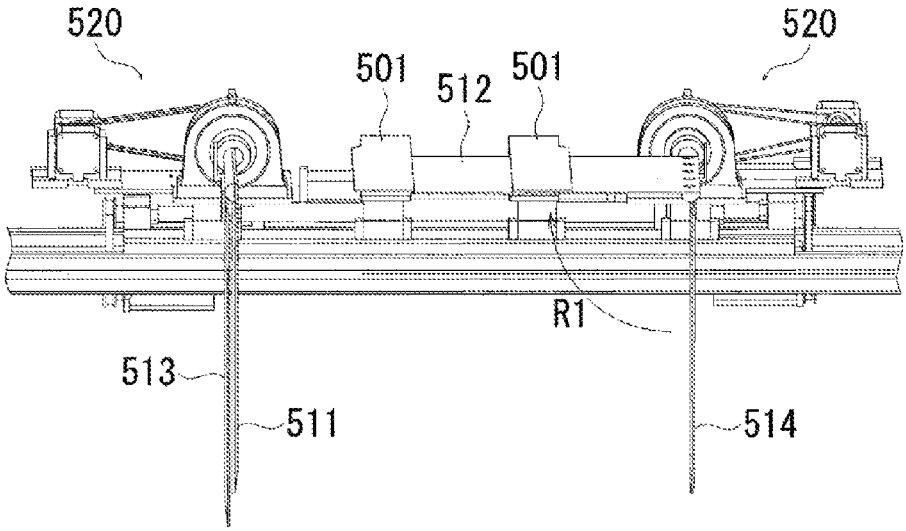
FIG. 7 is a front view of a folding mechanism, set to be in a second state, of the folding device of the automatic wash-dry-fold system according to the exemplary embodiment of the present invention.

Next, the inner shaft rotary motor 522 of the dual nested shaft rotary mechanism 520 rotates the second folding plate 512 leftward (clockwisedly) at an angle of roughly 90 degrees in FIG. 7 (see an arrow R1 in FIG. 7). The second folding plate 512 is thereby set to be in a state illustrated in FIG. 7 (a second state). In other words, the second folding plate 512 is disposed adjacent to the bottom face of the platen plate 501. It should be herein noted that a part of the laundry LD, hung down from the right side of the platen plates 501 in FIG. 7, is interposed and folded between the second folding plate 512 and the platen plate 501.

Figure 8:
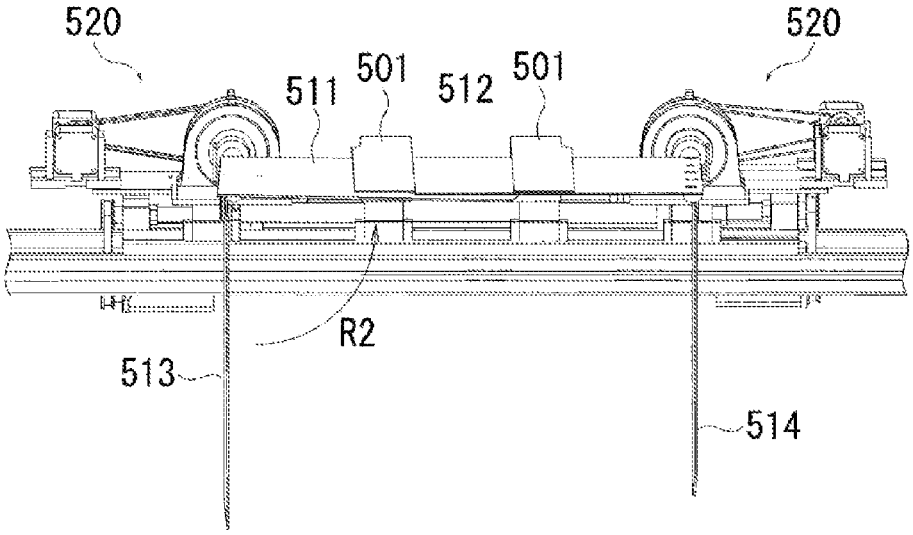
FIG. 8 is a front view of the folding mechanism, set to be in a third state, of the folding device of the automatic wash-dry-fold system according to the exemplary embodiment of the present invention.

Next, the inner shaft rotary motor 522 of the dual nested shaft rotary mechanism 520 rotates the first folding plate 511 rightward (counterclockwisedly) at an angle of roughly 90 degrees in FIG. 8 (see an arrow R2 in FIG. 8). The first folding plate 511 is thereby set to be in a state illustrated in FIG. 8 (a third state). In other words, the first folding plate 511 is disposed adjacent to the bottom face of the second folding plate 512. It should be herein noted that a part of the laundry LD, hung down from the left side of the platen plates 501 in FIG. 8, is interposed and folded between the first folding plate 511 and the second folding plate 512.

Figure 9:
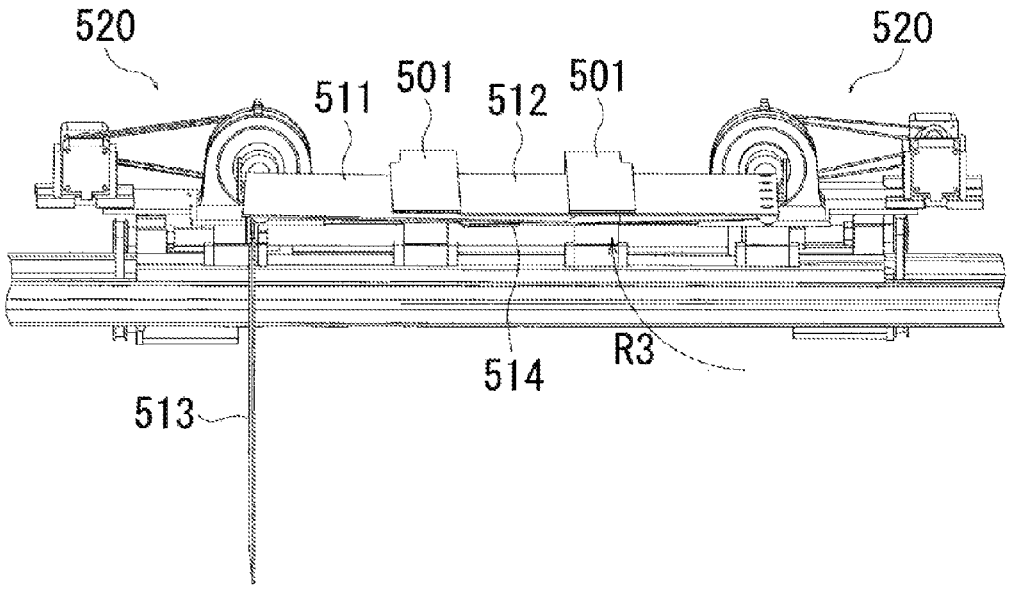
FIG. 9 is a front view of the folding mechanism, set to be in a fourth state, of the folding device of the automatic wash-dry-fold system according to the exemplary embodiment of the present invention.

Next, the outer shaft rotary motor 523 of the dual nested shaft rotary mechanism 520 rotates the fourth folding plate 514 leftward (clockwisedly) at an angle of roughly 90 degrees in FIG. 9 (see an arrow R3 in FIG. 9). The fourth folding plate 514 is thereby set to be in a state illustrated in FIG. 9 (a fourth state). In other words, the fourth folding plate 514 is disposed adjacent to the bottom face of the first folding plate 511. It should be herein noted that a part of the laundry LD, hung down from the right side of the first folding plates 511 in FIG. 9, is interposed and folded between the fourth folding plate 514 and the first folding plate 511.

Figure 10:
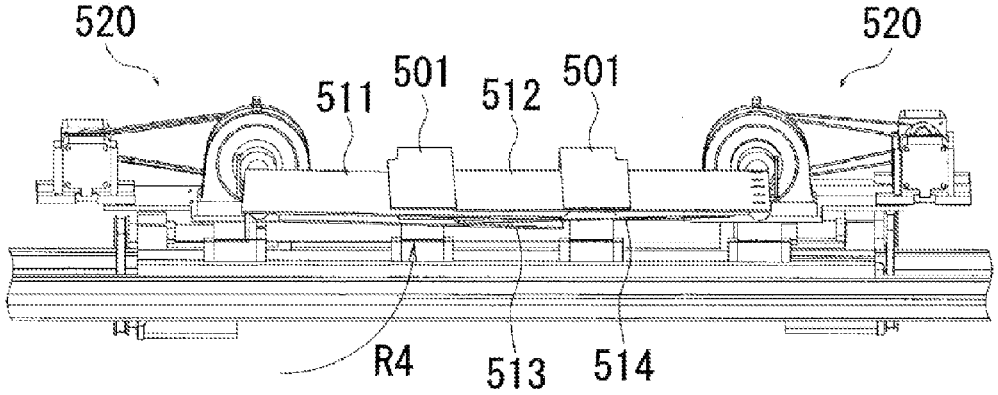
FIG. 10 is a front view of the folding mechanism, set to be in a fifth state, of the folding device of the automatic wash-dry-fold system according to the exemplary embodiment of the present invention.

Next, the outer shaft rotary motor 523 of the dual nested shaft rotary mechanism 520 rotates the third folding plate 513 rightward (counterclockwisedly) at an angle of roughly 90 degrees in FIG. 10 (see an arrow R4 in FIG. 10). The third folding plate 513 is thereby set to be in a state illustrated in FIG. 10 (a fifth state). In other words, the third folding plate 513 is disposed adjacent to the bottom face of the fourth folding plate 514. It should be herein noted that a part of the laundry LD, hung down from the left side of the fourth folding plate 514 in FIG. 10, is interposed and folded between the third folding plate 513 and the fourth folding plate 514.

Figure 11:
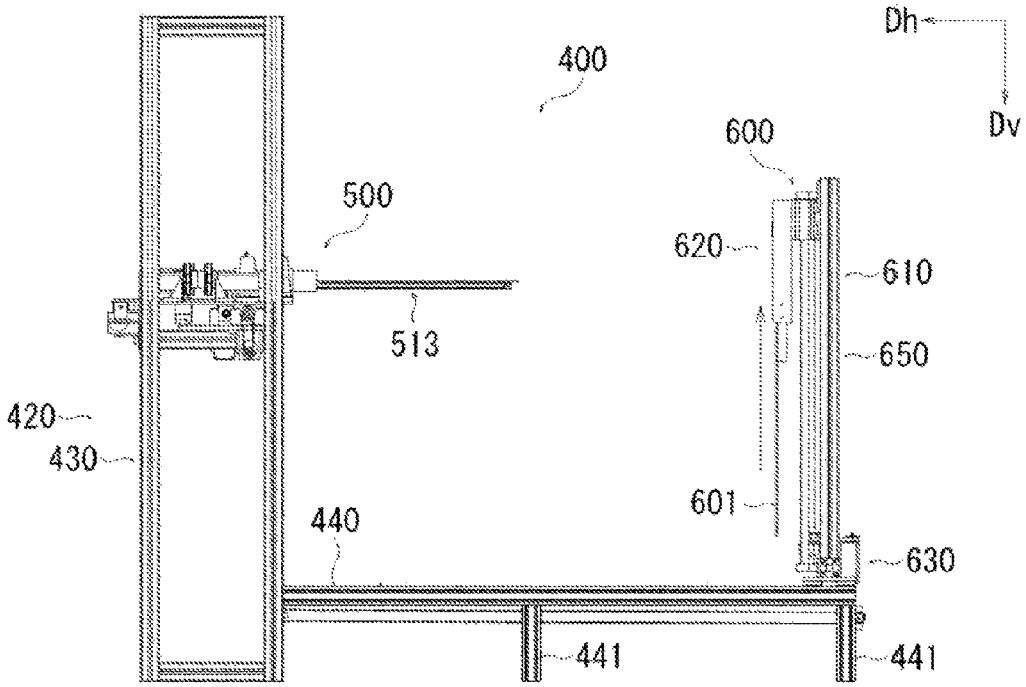
FIG. 11 is a side view of a transporting mechanism, set to be in a second state, of the folding device of the automatic wash-dry-fold system according to the exemplary embodiment of the present invention.
Figure 12:
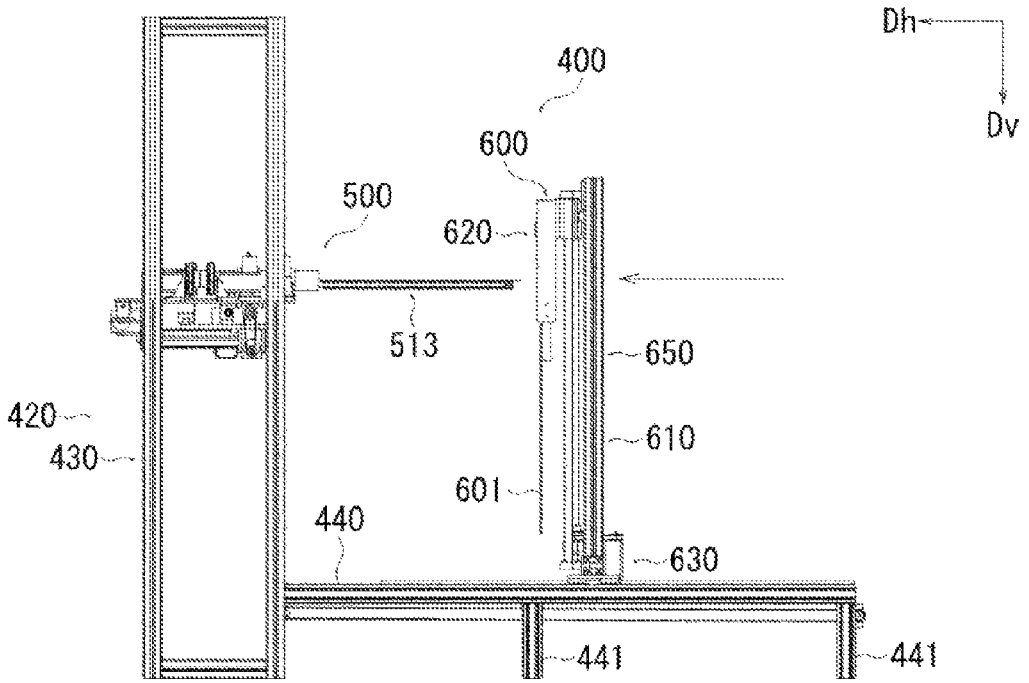
FIG. 12 is a side view of the transporting mechanism, set to be in a third state, of the folding device of the automatic wash-dry-fold system according to the exemplary embodiment of the present invention.
Figure 13:
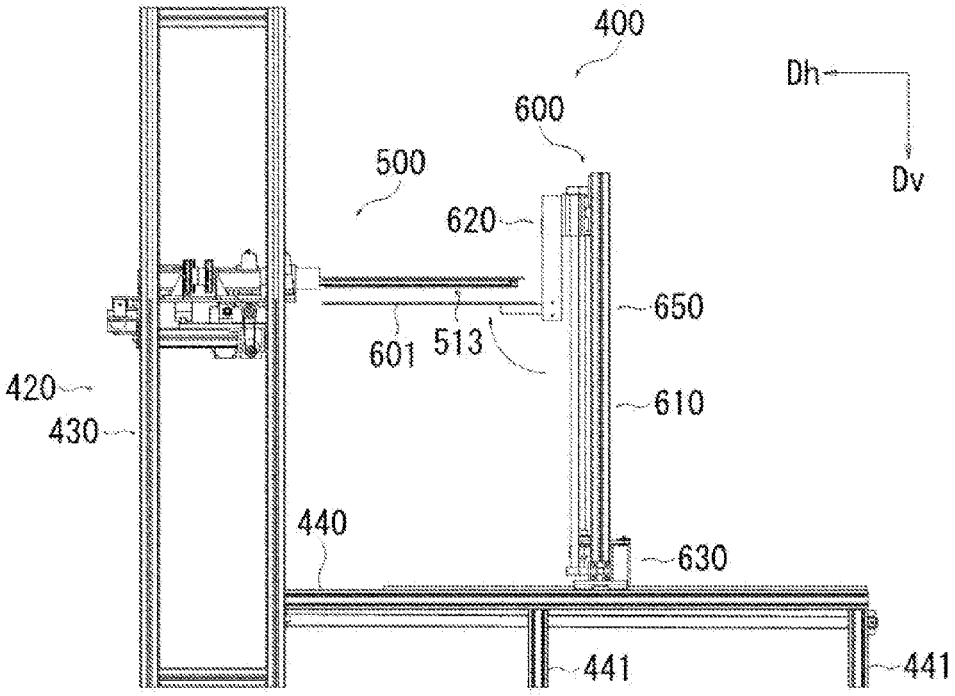
FIG. 13 is a side view of the transporting mechanism, set to be in a fourth state, of the folding device of the automatic wash-dry-fold system according to the exemplary embodiment of the present invention.

Next, the pull-out plate up-and-down transporting mechanism 610 lifts up the pull-out plate 601 to a predetermined height as illustrated in FIG. 11 (a second state). The pull-out plate back-and-forth transporting mechanism 630 then forwardly moves the pull-out plate 601 to a predetermined position as illustrated in FIG. 12 (a third state). It should be noted that the pull-out plate 601 is herein positioned while the plate face thereof is arranged along the vertical direction Dv. The pull-out plate rotary mechanism 620 then rotates the pull-out plate 601 to a position where the pull-out plate 601 is disposed roughly in parallel to the third folding plate 513 as illustrated in FIG. 13 (a fourth state).

Figure 14:
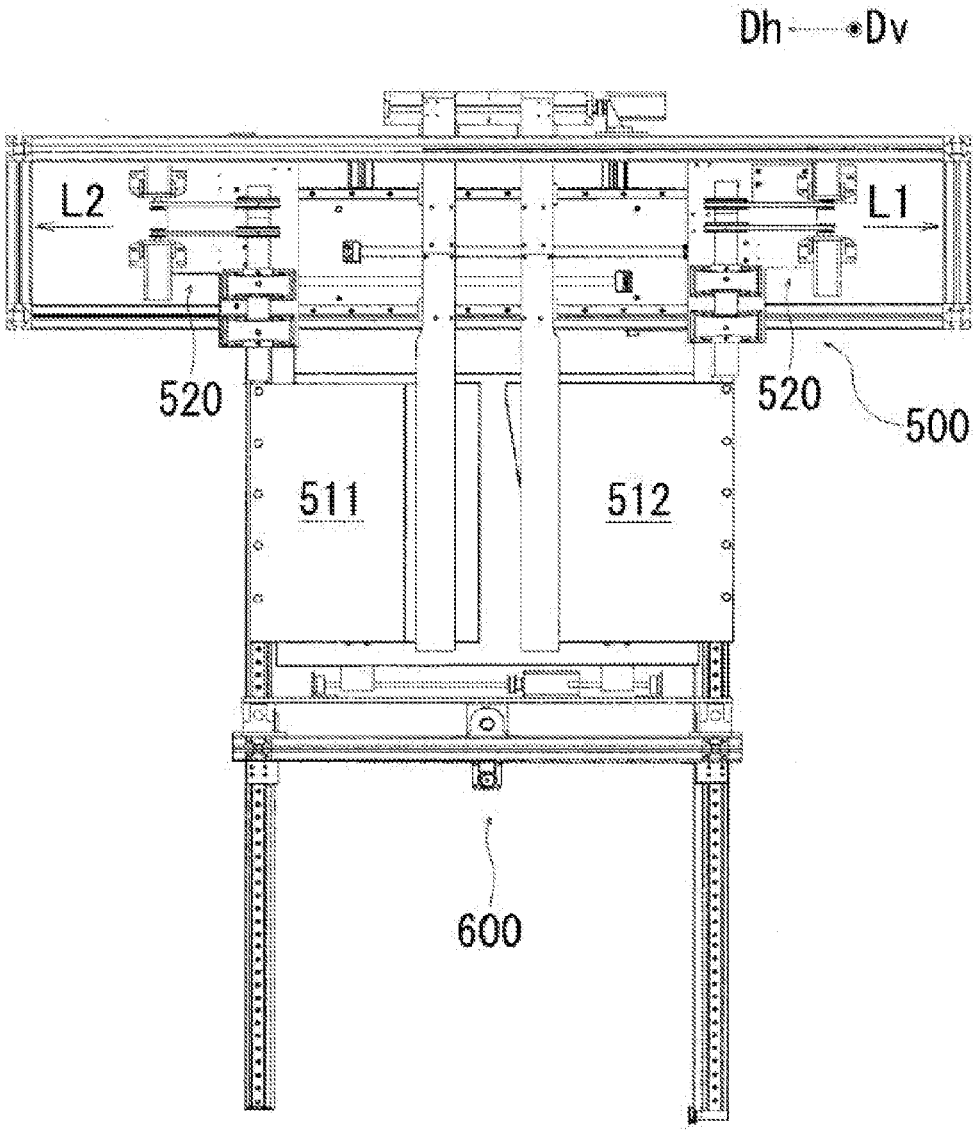
FIG. 14 is a plan view of the folding mechanism, set to be in a sixth state, of the folding device of the automatic wash-dry-fold system according to the exemplary embodiment of the present invention.

Subsequently, the right-side folding plate sliding mechanism 540 rightwardly slides and moves the right-side dual nested shaft rotary mechanism 520 in FIG. 10, while the left-side folding plate sliding mechanism 540 leftwardly slides and moves the left-side dual nested shaft rotary mechanisms 520 in FIG. 10 (see arrows L1 and L2 in FIG. 14). The folding device 400 is thereby set to be in a state illustrated in FIG. 14 (a sixth state). The folding plates 511 to 514 are herein removed from the laundry LD, and the laundry LD can be easily pulled out by means of the pull-out plate 601.

Then, the pull-out plate 601 is lifted down by the pull-out plate up-and-down transporting mechanism 610, while being backwardly moved by the pull-out plate back-and-forth transporting mechanism 630. The pull-out plate 601 is thereby set to be in a state illustrated in FIG. 4.

Subsequently, the pull-out plate rotary mechanism 620 rotates the pull-out plate 601 to a position where the pull-out plate 601 is downwardly tilted. With the action, the folded laundry LD on the pull-out plate 601 slips down to a sorting table 720 disposed below in a stand-by state.

(7) Sorting Device

Figure 15:
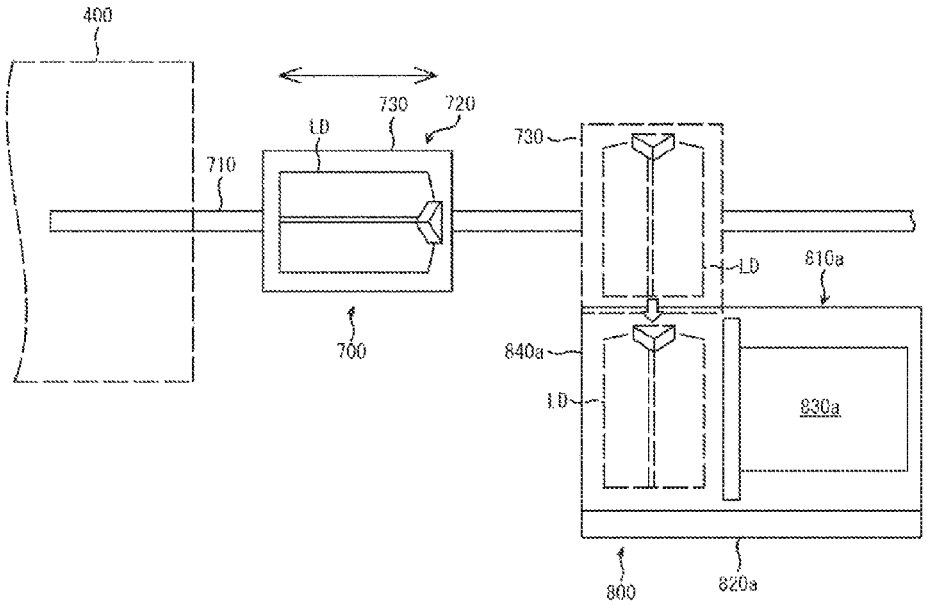
FIG. 15 is a plan view illustrating an arrangement relation among the folding device, a sorting device and the transporting device in the automatic wash-dry-fold system according to the exemplary embodiment of the present invention.

As illustrated in FIG. 15, the sorting device 700 mainly includes a rail 710, the sorting table 720 and sorting table detection sensors (not illustrated in the figures). As represented in FIG. 2, the sorting device 700 is communicatively connected to the control device 900.

As illustrated in FIG. 15, the rail 710 is linearly extended oppositely to the folding device 400 from a position below the folding device 400.

The sorting table 720 mainly includes a rail engaging portion (not illustrated in the figures), wheels, a driving motor (not illustrated in the figures), a platen plate 730, a 90-degree rotary mechanism (not illustrated in the figures) and a tilting mechanism (not illustrated in the figures). The rail engaging portion is engaged with the rail 710. The wheels are a pair of wheels disposed in the inside of the rail engaging portion. The wheels are disposed on the both lateral sides of the rail 710 while interposing the rail 710 therebetween. The wheels are configured to be driven by the driving motor. The driving motor is configured to be forwardly rotated, reversely rotated and stopped in response to a command from the control device 900. The platen plate 730 is a plate for being put thereon the laundry LD folded by the folding device 400. The platen plate 730 is disposed on the 90-degree rotary mechanism and the tilting mechanism. The 90-degree rotary mechanism is configured to rotate the platen plate 730 at an angle of 90 degrees (see the platen plate 730 depicted with a broken line in FIG. 15) in response to a command from the control device 900. The tilting mechanism is configured to tilt the platen plate 730 in response to a command from the control device 900 so that the plate face of the platen plate 730 is downwardly tilted towards a platen plate 840*a* (to be described) of a transporting table 810*a* (to be described).

Each of the sorting table detection sensors mainly includes a light emitter and a light receiver. The sorting table detection sensors are disposed in the vicinity of the rail 710 while being opposed to the positions where the transporting tables 810*a* to 810*d* are respectively disposed. It should be noted in the present exemplary embodiment that the light receivers are positioned higher than the sorting table 720 while the light emitters are positioned lower than the sorting table 720.

In the present exemplary embodiment, when receiving a command signal and storage position data D2 from the control device 900, the sorting device 700 is configured to cause the corresponding one of the sorting table detection sensors associated with the storage position data D2 to execute a sensing processing (i.e., emit light from the light emitter to the light receiver) and cause the other sorting table detection sensors to stop executing the sensing processing (i.e., stop light emission from the light emitter).

(8) Transporting Device

Figure 16:
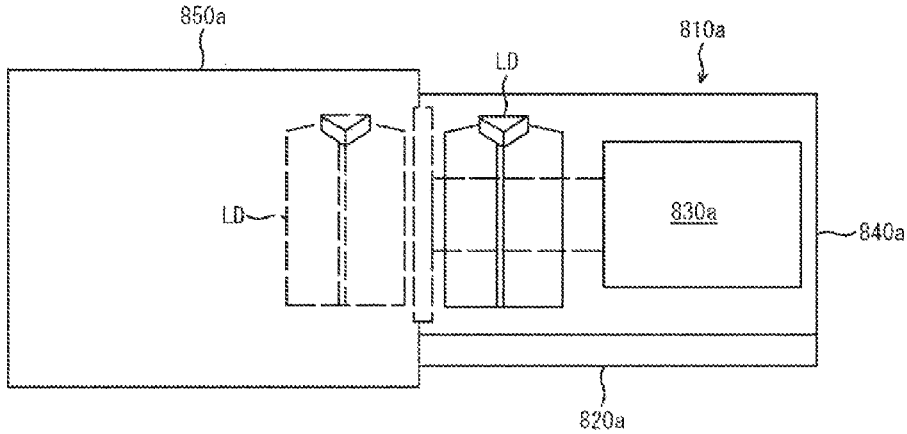
FIG. 16 is a diagram illustrating a condition where a laundry is moved from the transporting device to a closet in the automatic wash-dry-fold system according to the exemplary embodiment of the present invention.

As illustrated in FIGS. 1, 15 and 16, the transporting device 800 mainly includes the transporting tables 810*a* to 810*d*, level sensors (not illustrated in the figures) and transporting mechanisms 820*a* and 820*d*. It should be noted in the present exemplary embodiment that each of sections 850*a* to 850*d* of the closet 850 is independently provided with a pair of the transporting table (810*a* to 810*d*) and the transporting mechanism (820*a* to 820*d*). Further, the transporting device 800 is communicatively connected to the control device 900 as represented in FIG. 2. It should be noted that the transporting tables with the reference numerals of 810*a* to 810*d* are identical to each other. Therefore, only the transporting table with the reference numeral of 810*a* will be hereinafter explained. Likewise, the transporting mechanisms with the reference numerals of 820*a* to 820*d* are also identical to each other. Therefore, only the transporting mechanism with the reference numeral of 820*a* will be hereinafter explained.

The transporting table 810*a* mainly includes a belt joint portion (not illustrated in the figures), the platen plate 840*a* and a pusher device 830*a*. The belt joint portion is joined to a transporting belt (to be described) provided for the transporting mechanism 820*a*. The platen plate 840*a* is a plate for putting thereon the laundry LD sorted by the sorting device 700. The platen plate 840*a* is disposed on the belt joint portion. The pusher device 830*a* is disposed on the platen plate 840*a* while being positioned lateral to a laundry put area. The pusher device 830*a* is configured to push a piston in response to a command from the control device 900 (see FIG. 16).

Each level sensor mainly includes a light emitter and a light receiver. Each level sensor is disposed above the laundry put area on each of the transporting tables 810*a* to 810*d* while the laundry put area is interposed between the light emitter and the light receiver. When laundries are laminated to a predetermined height on the laundry put area, each level sensor is configured to detect it and transmit a detection signal to the control device 900. When receiving the detection signal, the control device 900 is configured to command the transporting device 800 to drive the corresponding one of the transporting tables 810*a* to 810*d* associated with the level sensor by means of the corresponding one of the transporting mechanisms 820*a* to 820*d*.

The transporting mechanism 820*a* mainly includes a transporting belt (not illustrated in the figures), a transporting belt driving mechanism (not illustrated in the figures) and a sensor (not illustrated in the figures). The transporting belt is an annular endless belt. The transporting belt driving mechanism is a mechanism configured to drive the transporting belt. The transporting belt driving mechanism is configured to start and stop driving of the transporting belt in response to a command from the control device 900.

In the present exemplary embodiment, when receiving a command signal and the storage position data D2 from the control device 900, the transporting device 800 is configured to drive the corresponding one of the transporting tables 810*a* to 810*d* by means of the corresponding one of the transporting mechanisms 820*a* to 820*d* and stop the transporting table (e.g., 810*a*) in front of the corresponding one of the storage spaces associated with the storage position data D2, and cause the transportation table (e.g., 810) to push the piston thereof.

(9) Closet

As illustrated in FIG. 1, the closet 850 is divided into four sections, i.e., the first section 850*a*, the second section 850*b*, the third section 850*c* and the fourth section 850*d*. Further, each of the sections 850*a* to 850*d* includes seven storage spaces aligned along the up-and-down direction.

(10) Control Device

As represented in FIG. 2, the control device 900 mainly includes a control unit 910, an arithmetic-and-logic unit 920, a storage unit 930 and a communication unit 940.

The control unit 910 is configured to control the arithmetic-and-logic unit 920, the storage unit 930 and the communication unit 940.

The arithmetic-and-logic unit 920 is configured to run a program stored in the storage unit 930 in response to a command from the control unit 910 in order to execute a variety of computations.

The storage unit 930 stores the aforementioned program, and further, a matching table Tr as represented in FIG. 3. In the matching table Tr, the platen plate width data D1 and the storage position data D2 are associated with the identification number data D0.

As represented in FIG. 2, the communication unit 940 is communicatively connected through a communication line to an electronic meter 50, the washing machine 200, the drying machine 250, the RFID tag readers 331 to 333, the laundry transporting robot arm 310, the dried laundry transporting robot arm 320, the folding device 400, the sorting device 700 and the transporting device 800. The communication unit 940 is configured to receive data and a notifying signal from the aforementioned devices and send a variety of command signals thereto.

<Actions of Automatic Wash-Dry-Fold System>

The control device 900 is configured to send a first command signal to the washing machine 200 when the weight of a laundry basket disposed in a predetermined position reaches a first threshold value (note the electronic meter 50 (see FIG. 2) is disposed under the laundry basket). When receiving the first command signal, the washing machine 200 is configured to open the lid thereof.

Next, the control device 900 is configured to send a second command signal to the laundry transporting robot arm 310. When receiving the second command signal, the laundry transporting robot arm 310 is configured to pick up the laundries LD from the laundry basket on a one-by-one basis and put them into the washing machine 200.

Next, the control device 900 is configured to send a third command signal to the laundry transporting robot arm 310 and send a fourth command signal to the washing machine 200 when the weight measured value of the first weight sensor 210 embedded in the washing machine 200 reaches a second threshold value. When receiving the third command signal, the laundry transporting robot arm 310 is configured to be automatically stopped. When receiving the fourth command signal, the washing machine 200 is configured to close the lid thereof, put a detergent and a softener into the washing tub from the dispenser 220, and start a washing operation.

When washing is completed (i.e., when the washing operation is stopped), the washing machine 200 is subsequently configured to send a washing completion notifying signal to the control device 900, and simultaneously, open the lid thereof. When receiving the washing completion notifying signal, the control device 900 is then configured to send a fifth command signal to the drying machine 250 and send a sixth command signal to the laundry transporting robot arm 310.

When receiving the fifth command signal, the drying machine 250 is configured to open the lid thereof. When receiving the sixth command signal, on the other hand, the laundry transporting robot arm 310 is configured to pick up the laundries LD from the washing machine 200 on a one-by-one basis and put the laundries LD into the drying machine 250.

Subsequently, the control device 900 is configured to send a seventh command signal to the laundry transporting robot arm 310, send an eighth command signal to the washing machine 200, and further send a ninth command signal to the drying machine 250, when the weight measured value of the first weight sensor 210 embedded in the washing machine 200 reaches a third threshold (less than the second threshold). When receiving the seventh command signal, the laundry transporting robot arm 310 is configured to be automatically stopped after a predetermined period of time elapses. When receiving the eighth command signal, on the other hand, the washing machine 200 is configured to close the lid thereof. When receiving the ninth command signal, the drying machine 250 is configured to close the lid thereof and start a drying operation.

When drying process is completed (i.e., the drying operation is stopped), the drying machine 250 is configured to send a drying completion notifying signal to the control device 900, and simultaneously, open the lid thereof. When receiving the drying completion notifying signal, the control device 900 is configured to send a tenth command signal to the dried laundry transporting robot arm 320. When receiving the tenth command signal, the dried laundry transporting robot arm 320 is configured to pick up one of the dried laundries LD from the drying machine 250 and stop moving at a predetermined position.

When halting at the predetermined position, the dried laundry transporting robot arm 320 is then configured to send a first halt notifying signal to the control device 900. When receiving the first halt notifying signal, the control device 900 is configured to send an eleventh command signal to the laundry transporting robot arm 310. When receiving the eleventh command signal, the laundry transporting robot arm 310 is configured to clamp another part of the laundry LD currently clamped by the dried laundry transporting robot arm 320. In other words, the laundry LD is clamped by both of the laundry transporting robot arm 310 and the dried laundry transporting robot arm 320.

When clamping the laundry LD, the laundry transporting robot arm 310 is configured to send a clamp completion notifying signal to the control device 900. When receiving the clamp completion notifying signal, the control device 900 is configured to send a twelfth command signal to the laundry transporting robot arm 310 and the dried laundry transporting robot arm 320. When receiving the twelfth command signal, the laundry transporting robot arm 310 and the dried laundry transporting robot arm 320 are configured to transport the laundry LD clamped by the both rams 310 and 320 to a readable range for the RFID tag reader 332 and stop moving in the position.

When transporting the laundry LD to the readable range for the RFID tag reader 332 and halting in the position, the laundry transporting robot arm 310 and the dried laundry transporting robot arm 320 are configured to send a second halt notifying signal to the control device 900. When receiving the second halt notifying signal, the control device 900 is configured to send a thirteenth command signal to the RFID tag reader 332. When receiving the thirteenth command signal, the RFID tag reader 332 is configured to irradiate radio waves to the RFID tags attached to the laundry LD and receive the identification number data D0 from the RFID tags.

When receiving the identification number data D0 from the RFID tags, the RFID tag reader 332 is configured to send the identification number data D0 to the control device 900.

When receiving the identification number data D0, the control device 900 is configured to check the identification number data D0 against the matching table Tr stored in the storage unit 930 and derive the platen plate width data D1 and the storage position data D2, both of which are associated with the identification number data D0. Subsequently, the control device 900 is configured to send the platen plate width data D1 to the folding device 400, and simultaneously, send the storage position data D2 to the sorting device 700.

When receiving the platen plate width data D1 and a fourteenth command signal, the folding device 400 is configured to adjust the width between the platen plates 501 based on the platen plate width data D1. When completing the width adjustment, the folding device 400 is then configured to send an adjustment completion notifying signal to the control device 900. When receiving the adjustment completion notifying signal, the control device 900 is configured to send the fourteenth command signal to the laundry transporting robot arm 310 and the dried laundry transporting robot arm 320. When receiving the fourteenth command single, the laundry transporting robot arm 310 and the dried laundry transporting robot arm 320 are configured to put the laundry LD on the platen plates 501 of the folding device 400.

After unclamping the laundry LD, the laundry transporting robot arm 310 and the dried laundry transporting robot arm 320 are subsequently configured to send a laundry release notifying signal to the control device 900. When receiving the laundry release notifying signal, the control device 900 is then configured to send a fifteenth command signal to the folding device 400.

When receiving the fifteenth command signal, the folding device 400 is configured to fold the laundry LD and transport the folded laundry LD to the sorting table 720 of the sorting device 700. When completing transportation of the laundry LD to the sorting table 720, the folding device 400 is configured to send a transport completion notifying signal to the control device 900. When receiving the transport completion notifying signal, the control device 900 is configured to send a tenth command signal to the dried laundry transporting robot arm 320. When receiving the tenth command signal, the dried laundry transporting robot arm 320 is configured to pick up one of the dried laundries LD from the drying machine 250 and halt at a predetermined position. The aforementioned processing will be subsequently repeated as described above.

Next, the control device 900 is configured to send a sixteenth command signal to the laundry transporting robot arm 310 and the dried laundry transporting robot arm 320 and send a seventeenth command signal to the drying machine 250, when a sensor value of the second weight sensor (see FIG. 2) embedded in the drying machine 250 reaches a fourth threshold (i.e., when the dryer drum becomes empty). When receiving the sixteenth command signal, the laundry transporting robot arm 310 and the dried laundry transporting robot arm 320 are configured to automatically stop. When receiving the seventeenth command signal, on the other hand, the drying machine 250 is configured to close the lid thereof.

Meanwhile, when receiving the storage position data D2 and an eighteenth command signal, the sorting device 700 is configured to cause one of the sorting table detection sensors corresponding to the storage position data D2 to execute a sensing processing (i.e., cause the light emitter thereof to irradiate light to the light receiver thereof) and cause the other sorting table detection sensors to stop executing a sensing processing (i.e., cause the light emitters thereof to stop irradiating light). Accordingly, the sorting table 720 is configured to stop in front of one of the transporting tables 810*a* to 810*d* corresponding to the storage position data D2.

Next, the sorting device 700 is configured to send a detection notifying signal of the sorting table detection sensor to the control device 900. When receiving the detection notifying signal, the control device 900 is configured to send a nineteenth command signal to the sorting device 700.

Next, when receiving the nineteenth command signal, the sorting device 700 is configured to cause the 90-degree rotary mechanism to rotate the platen plate 730 at an angle of 90 degrees (see the platen plate 730 depicted with a broken line in FIG. 15) and then cause the tilting mechanism to tilt the platen plate 730 so that the plate face of the platen plate 730 is downwardly tilted towards the corresponding one of the platen plates 840*a* to 840*d* of the transporting tables 810*a* to 810*d*. Accordingly, the laundry LD slides down onto one of the transporting tables 810*a* to 810*d* corresponding to the storage portion data D2 from the platen plate 730 of the sorting table 720 (see FIG. 15).

When the laundries LD are thus laminated on each of the transporting tables 810*a* to 813*d* to a predetermined height, the top one of the laundries LD is detected by the level sensor. When confirming detection by the level sensor, the transporting device 800 is configured to send a detection notifying signal to the control device 900. When receiving the detection notifying signal, the control device 900 is configured to send a twentieth command signal to the transporting device 800. When receiving the twentieth command signal, the transporting device 800 is configured to drive one of the transporting tables 810*a* to 810*d* corresponding to the aforementioned level sensor by means of the corresponding one of the transporting mechanisms 820*a* to 820*d*. Further, the transporting device 800 is configured to cause the corresponding one of the transporting tables 810*a* to 810*d* to stop in front of one of the storage spaces corresponding to the storage position data D2 and then push the piston for moving the laundry LD to the storage space corresponding to the storage position data D2.

<Features of Automatic Wash-Dry-Fold System>

(1)

The automatic wash-dry-fold system 100 according to the present exemplary embodiment is configured to completely automatically wash, dry, fold, sort and store laundries. Therefore, the automatic wash-dry-fold system 100 only requires a worker to put laundries on a laundry basket. Therefore, it is possible to remarkably reduce worker's workload required for washing, drying and folding laundries.

(2)

In the automatic wash-dry-fold system 100 according to the present exemplary embodiment, the RFID tag reader 332 is configured to obtain the identification number data D0 from the RFID tags and the control device 900 is configured to check the identification number data D0 against the matching table Tr. Accordingly, the platen plate width data D1 and the storage position data D2 are derived based on the matching. Therefore, the RFID tags are required to hold a less amount of information in the automatic wash-dry-fold system 100. As a result, the automatic wash-dry-fold system 100 can reduce the cost required for the RFID tags and reduce chances of causing troubles, for instance, in repurchase of fabric products (e.g., clothing).

(3)

The automatic wash-dry-fold system 100 according to the present exemplary embodiment is provided with the sorting device 700. Further, the sorting device 700 is configured to sort the laundries LD based on the storage position data D2. Therefore, the automatic wash-dry-fold system 100 can sort the laundries LD based on owners of the laundries LD or storage positions. Therefore, the automatic wash-dry-fold system 100 can eliminate sorting-related workload of a worker.

(4)

The automatic wash-dry-fold system 100 according to the present exemplary embodiment is provided with the transporting device 800. Further, the transporting device 800 is configured to move the laundries LD to the storage spaces based on the storage position data D2. Therefore, the automatic wash-dry-fold system 100 can eliminate a storage-related workload of a worker.

(5)

In the present exemplary embodiment, all the laundries LD include the passive-type RFID tags (not illustrated in the figures) attached thereto at two predetermined positions (e.g., "a shoulder part" for a shirt, "a waist part" for pants, etc.). Further, the automatic wash-dry-fold system 100 according to the present exemplary embodiment is provided with three RFID tag readers 331 to 333 configured to detect the positions of the RFID tags by means of the triangulation method. Yet further, the automatic wash-dry-fold system 100 is provided with the laundry transporting robot arm 310, the dried laundry transporting robot arm 320 and the control device 900. Therefore, the automatic wash-dry-fold system 100 can cause the laundry transporting robot arm 310 and the dried laundry transporting robot arm 320 to easily clamp the laundry LD at appropriate clamping positions. Therefore, the automatic wash-dry-fold system 100 can properly put the laundry LD on the platen plates 501 of the folding device 400.

<Modifications>

(A)

In the aforementioned exemplary embodiment, the RFID tags contain the identification number data D0. However, the RFID tags may contain the platen plate width data D1 and the storage position data D2 instead of the identification number data D0. With the configuration, the matching table Tr and the matching processing are not required.

(B)

The automatic wash-dry-fold system 100 of the aforementioned exemplary embodiment uses the RFID tags as the storage media of the identification number data D0. However, a barcode (e.g., a one-dimensional barcode, a two-dimensional barcode, etc.) may be used as the storage medium of the identification number data D0. It should be noted that a barcode reader is herein required instead of the RFID tag readers 331 to 333. Further, the positional detection of the barcode is herein very difficult. Therefore, the positional detection is not herein executed and a worker is required to manually cause the laundry transporting robot arm 310 and the dried laundry transporting robot arm 320 to clamp the laundry LD. Yet further, the barcode is herein preferably attached to the lining of the laundry LD without being outstandingly visible to the outside.

Moreover, the platen plate width data D1 and the storage position data D2 may be converted into barcodes without using the identification number data D0, as described in the aforementioned exemplary modification (A).

(C)

In the automatic wash-dry-fold system 100 of the aforementioned exemplary embodiment, the identification number data D0 of the RFID tags is configured to be checked against the matching table Tr and the platen plate width data D1 and the storage position data D2 are configured to be derived therefrom. However, the following configuration may be employed instead of the above.

First, an imaging device such as a camera is configured to preliminarily obtain the imaging data of the laundry LD or the imaging data of a distinctive part of the laundry LD. Then, a matching table is preliminarily created by associating the imaging data with the platen plate width data D1 and the storage position data D2. It should be herein noted that the imaging data may be obtained by irradiating light or the like from the back of the laundry LD.

Next, the imaging device such as a camera images the laundry LD, and the control device 900 checks the imaging data (either partially or entirely) against the aforementioned matching table and derives the platen plate width data D1 and the storage position data D2 therefrom.

It should be herein noted that the imaging device used for creating the matching table and the imaging device used for checking the matching table may be identical to or different from each other. When the imaging data of the entirety of the laundry LD is used for creating the matching table, positional detection is quite difficult. Therefore, a worker is required to manually cause the laundry transporting robot arm 310 and the dried laundry transporting robot arm 320 to clamp the laundry LD without executing positional detection. By contrast, when the imaging data of the distinctive part of the laundry LD is used for creating the matching table, positional detection of the distinctive part may be executed and the laundry transporting robot arm 310 and the dried laundry transporting robot arm 320 may be caused to clamp the distinctive part of the laundry LD.

(D)

In the automatic wash-dry-fold system 100 of the aforementioned exemplary embodiment, the RFID tags are used as the storage media of the identification number data D0. However, fluorescent paint of a variety of colors may be used as the storage media of the identification number data D0. It should be herein noted that a black light and an imaging device are required instead of the RFID tag readers 331 to 333. Further, barcodes may be herein formed using the fluorescent paints.

In this case, a matching table is preliminarily created by associating the data of colors and/or shapes of the fluorescent paint with the platen plate width data D1 and the storage position data D2. Further, the laundry LD is imaged while being irradiated by a black light. The control device 900 checks the color and/or the shape of the fluorescent paint in the imaging data (either partially or entirely) against the aforementioned matching table and derives the platen plate width data D1 and the storage position data D2 therefrom.

It should be herein noted that the fluorescent paint may be applied to two predetermined positions (e.g., "a shoulder part" of a shirt, "a waist part" of pants, etc.) and positional detection of the fluorescent-paint applied parts may be executed. Further, the laundry transporting robot arm 310 and the dried laundry transporting robot arm 320 may be caused to clamp the fluorescent-paint applied parts of the laundry LD.

Moreover, the platen plate width data D1 and the storage position data D2 may be converted into barcodes without using the data of the color and/or the shape of the fluorescent paint, as described in the aforementioned exemplary modification (A).

(E)

In the automatic wash-dry-fold system 100 of the aforementioned exemplary embodiment, the RFID tags are used as the storage media of the identification number data D0. However, metal pieces made of a variety of metal elements may be used as the storage media of the identification number data D0. It should be herein noted that a metal detector is required instead of the RFID tag readers 331 to 333.

In this case, a matching table is preliminarily created by associating the data such as detection sensitivity with the platen plate width data. D1 and the storage position data D2. Further, the metal detector is actuated with respect to the laundry LD, and the control device 900 checks the detection sensitivity of the metal detector against the matching table and derives the platen plate width data D1 and the storage position data D2 therefrom.

It should be herein noted that two metal pieces may be disposed on two predetermined positions (e.g., "a shoulder part" of a shirt, "a waist part" of pants, etc.) and positional detection of the metal pieces may be executed. Further, the laundry transporting robot arm 310 and the dried laundry transporting robot arm 320 may be caused to clamp the metal piece embedded portions of the laundry LD.

(F)

In the automatic wash-dry-fold system 100 of the aforementioned exemplary embodiment, the RFID tags are used as the storage media of the identification number data D0. However, magnetic recording media may be used as the storage media for the identification number data D0. It should be herein noted that a magnetic recording reader is required instead of the RFID tag readers 331 to 333.

It should be herein noted that two magnetic recording media may be disposed on two predetermined positions (e.g., "a shoulder part" of a shirt, "a waist part" of pants, etc.) and positional detection of the magnetic recording media may be executed. Further, the laundry transporting robot arm 310 and the dried laundry transporting robot arm 320 may be caused to clamp the magnetic recording media embedded portions of the laundry LD.

Moreover, the platen plate width data D1 and the storage position data D2 may be stored instead of the identification number data D0, as described in the aforementioned exemplary modification (A).

(G)

Figure 17:
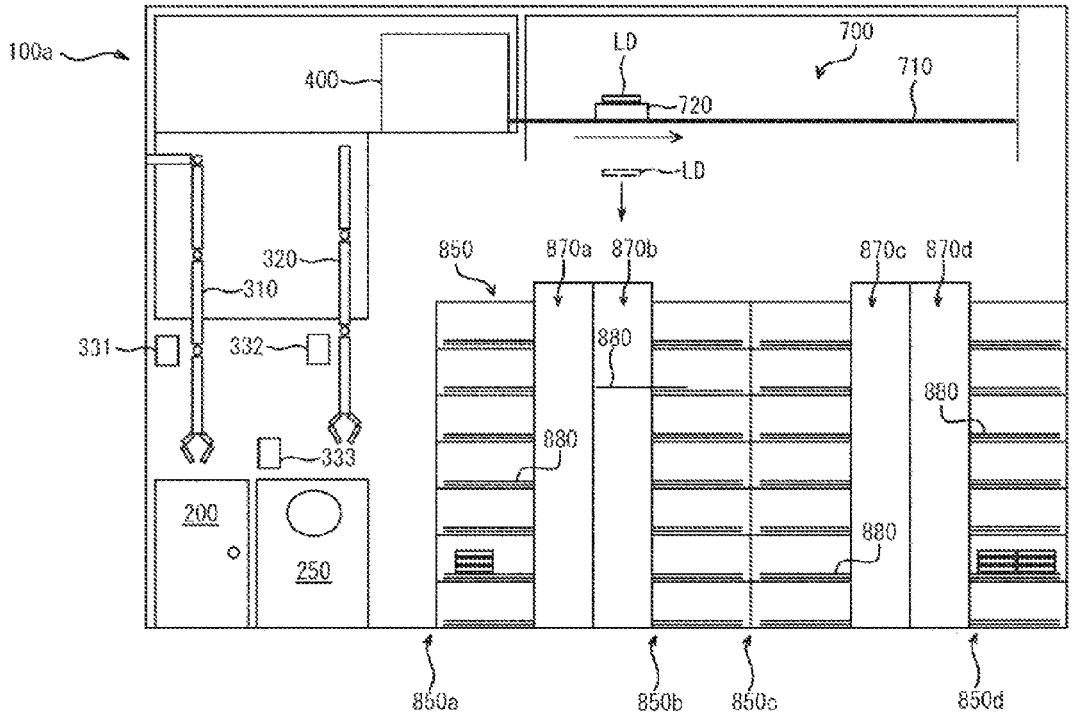
FIG. 17 is a schematic configuration diagram of an automatic wash-dry-fold system according to a modification (G).

In the automatic wash-dry-fold system 100 of the aforementioned exemplary embodiment, the transporting device 800 is configured to move the laundry LD sorted by the sorting device 700 to one of the storage spaces corresponding to the storage position data D2. Alternatively, an automatic wash-dry-fold system 100*a* may be structured as illustrated in FIG. 17. In the automatic wash-dry-fold system 100*a*, the laundry LD sorted by the sorting device 700 is transported by means of free fall.

It should be noted that the automatic wash-dry-fold system 100*a* as described above includes falling spaces 870*a* to 870*d* for the sections 850*a* to 850*d*, respectively, and each of the storage spaces is provided with a pull-in slide plate 880. In response to a command from the control device 900, a driving device (not illustrated in the figure) is configured to drive the pull-in slide plates 880 to protrude towards the falling spaces for receiving the falling laundries LD and then retract the pull-in slide plates 880 for pulling the received laundries LD into the storage spaces. The configuration is expected to contribute to energy saving.

(H)

In the automatic wash-dry-fold system 100 of the aforementioned exemplary embodiment, laundries are completely automatically washed, dried, folded, sorted and stored. However, laundries may be manually washed and dried. In this case, the laundry LD may be manually taken out of the drying machine 250 and may be manually passed over the RFID tag readers 331 to 333. Subsequently, the laundry transporting robot arm 310 and the dried laundry transporting robot arm 320 may be manually caused to clamp the laundry LD. Even in this configuration, a worker is only required to execute a work for assisting input of the identification number data D0 into the control device 900 (e.g., a work for taking a fabric product closer to the control device 900). Therefore, it is possible to reduce worker's workload required for width adjustment of the platen plates 501.

The washing machine 200 as described above is employed in the automatic wash-dry-fold system 100 of the aforementioned exemplary embodiment. However, any other washing machines may be employed without departing from the scope of the present invention.

(J)

The drying machine 250 as described above is employed in the automatic wash-dry-fold system 100 of the aforementioned exemplary embodiment. However, any other drying machines may be employed without departing from the scope of the present invention.

(K)

The laundry transporting robot arm 310 and the dried laundry transporting robot arm 320, as described above, are employed in the automatic wash-dry-fold system 100 of the aforementioned exemplary embodiment. However, any other robot arms may be employed without departing from the scope of the present invention.

(L)

The flip-up-to-the-bottom type folding mechanism 500 is employed for the folding device 400 in the automatic wash-dry-fold system 100 of the aforementioned exemplary embodiment. However, a rotary type folding mechanism, a flip-up-to-the-top type folding mechanism or a slide type folding mechanism may be employed as the folding mechanism of the present invention.

(M)

The sorting device 700 as described above is employed in the automatic wash-dry-fold system 100 of the aforementioned exemplary embodiment. However, any other sorting devices may be employed without departing from the scope of the present invention.

(N)

The transporting device 800 as described above is employed in the automatic wash-dry-fold system 100 of the aforementioned exemplary embodiment. However, any other transporting devices may be employed without departing from the scope of the present invention.

INDUSTRIAL APPLICABILITY

The folding system for a fabric product according to the present invention is characterized in that worker's workload required for width adjustment of a platen can be reduced, and is especially useful as a home-use folding system for a fabric product.

The invention claimed is:

1. A folding system for a fabric product, comprising:

an information obtaining device configured to obtain first information held by the fabric product;

a folding device including; a platen member for putting the fabric product thereon, a width adjusting mechanism configured to adjust a width directional length of the platen member, and a folding mechanism configured to fold the fabric product on the platen member;

a width controlling device configured to control the width adjusting mechanism by using the first information obtained by the information obtaining device;

a first storage device configured to store a first association table for associating the first information with second information; and a second information deriving device configured to check the first information obtained by the information obtaining device against the first association table and derive the second information associated with the first information therefrom, the width controlling device being further configured to control the width adjusting mechanism by using the second information derived by the second information deriving device, and the first information including identification information for the fabric product.

2. The folding system for a fabric product recited in claim 1, further comprising a position detecting device configured to detect a position of the first information;

a clamping device configured to clamp the fabric product; and a clamping device controlling device configured to control the clamping device to hold the position detected by the position detecting device and put the fabric product on the platen member, the fabric product including a medium containing the first information, and the medium being fixed to a predetermined position on the fabric product.

3. A folding system for a fabric product comprising:

an information obtaining device configured to obtain first information held by the fabric product;

a folding device including: a platen member for putting the fabric product thereon, a width adjusting mechanism configured to adjust a width directional length of platen member, and a folding mechanism configured to fold the fabric product on the platen member;

a width controlling device configured to control the width adjusting mechanism by first information obtained by the information obtaining device; and a sorting device configured to sort the fabric product folded by the folding device by using the first information.

4. The folding system for a fabric product recited in claim 3, further comprising a second storage device configured to store a second association table for associating the first information with third information; and a third information deriving device configured to check the first information obtained by the information obtaining device against the second association table and derive the third information associated with the first information therefrom, the sorting device being further configured to sort the fabric product folded by the folding device by using the third information derived by the third information deriving device, and the first information including identification information for the fabric product.

5. The folding system for a fabric product recited in claim 4, further comprising a position detecting device configured to detect a position of the first information;

a clamping device configured to clamp the fabric product; and a clamping device controlling device configured to control the clamping device to hold the position detected by the position detecting device and put the fabric product on the platen member, the fabric product including a medium containing the first information, and the medium being fixed to a predetermined position on the fabric product.

6. The folding system for a fabric product recited in claim 3, further comprising:

a transporting device configured to transport the fabric product sorted by the sorting device to a predetermined storage position by using the first information.

7. The folding system for a fabric product recited in claim 6, further comprising a position detecting device configured to detect a position of the first information;

a clamping device configured to clamp the fabric product; and a clamping device controlling device configured to control the clamping device to hold the position detected by the position detecting device and put the fabric product on the platen member, the fabric product including a medium containing the first information, and the medium being fixed to a predetermined position on the fabric product.

8. The folding system for a fabric product recited in claim 6, further comprising a third storage device configured to store a third association table for associating the first information with fourth information; and a fourth information deriving device configured to check the first information obtained by the information obtaining device against the third association table and derive the fourth information associated with the first information therefrom, the transporting device being further configured to transport the fabric product sorted by the sorting device to a predetermined storage position by using the fourth information derived by the fourth information deriving device, and the first information including identification information for the fabric product.

9. The folding system for a fabric product recited in claim 8, further comprising a position detecting device configured to detect a position of the first information;

a clamping device configured to clamp the fabric product; and a clamping device controlling device configured to control the clamping device to hold the position detected by the position detecting device and put the fabric product on the platen member, the fabric product including a medium containing the first information, and the medium being fixed to a predetermined position on the fabric product.

10. The folding system for a fabric product recited in claim 8, wherein the sorting device is disposed below or lateral to the folding device, and the transporting device is disposed below the sorting device.

11. The folding system for a fabric product recited in claim 10 further comprising a position detecting device configured to detect a position of the first information;

a clamping device configured to clamp the fabric product; and a clamping device controlling device configured to control the clamping device to hold the position detected by the position detecting device and put the fabric product on the platen member, the fabric product including a medium containing the first information, and the medium being fixed to a predetermined position on the fabric product.

12. The folding system for a fabric product recited in claim 6, wherein the sorting device is disposed below or lateral to the folding device, and the transporting device is disposed below the sorting device.

13. The folding system for a fabric product recited in claim 12, further comprising a position detecting device configured to detect a position of the first information;

a clamping device configured to clamp the fabric product; and a clamping device controlling device configured to control the clamping device to hold the position detected by the position detecting device and put the fabric product on the platen member, the fabric product including a medium containing the first information, and the medium being fixed to a predetermined position on the fabric product.

14. The folding system for a fabric product recited in claim 3, further comprising a position detecting device configured to detect a position of the first information;

a clamping device configured to clamp the fabric product; and a clamping device controlling device configured to control the clamping device to hold the position detected by the position detecting device and put the fabric product on the platen member, the fabric product including a medium containing the first information, and the medium being fixed to a predetermined position on the fabric product.

15. A folding system for a fabric product comprising:

an information obtaining device configured to obtain first information held by the fabric product;

a folding device including: a platen member for putting the fabric product thereon, a width adjusting mechanism configured to adjust width directional length of the platen member, and a folding mechanism configured to fold the fabric product on the platen member;

a width controlling device configured to control the width adjusting mechanism by using the first information obtained by the information obtaining device;

a position detecting device configured to detect a position of the first information;

a clamping device configured to clamp the fabric product; and a clamping device controlling device configured to control the clamping device to hold the position detected by the position detecting device and put the fabric product on the platen member, the fabric product including a medium containing the first information, and the medium being fixed to a predetermined position on the fabric product.

* * * * *